US006892499B1

(12) United States Patent
Mayle

(10) Patent No.: US 6,892,499 B1
(45) Date of Patent: May 17, 2005

(54) APPARATUS AND METHOD FOR SEALING A VERTICAL PROTRUSION ON A ROOF

(76) Inventor: Steven R. Mayle, 2274 Augusta Dr., Fremont, OH (US) 43420

( * ) Notice: Subject to any disclaimer, the term of this patent is extended or adjusted under 35 U.S.C. 154(b) by 0 days.

(21) Appl. No.: 10/124,931

(22) Filed: Apr. 18, 2002

Related U.S. Application Data

(60) Provisional application No. 60/353,251, filed on Feb. 1, 2002.

(51) Int. Cl.[7] ..... E04H 12/28; E04C 2/52; E04D 1/36; E04D 13/14

(52) U.S. Cl. ..... 52/219; 52/218; 52/220.8; 52/58; 285/42; 285/43

(58) Field of Search ..... 52/218, 219, 220.8, 52/741.4, 58; 285/42, 43, 44

(56) References Cited

U.S. PATENT DOCUMENTS

| | | | | | |
|---|---|---|---|---|---|
| 322,153 | A | | 7/1885 | Blair et al. | |
| 549,352 | A | | 11/1895 | Folger | 285/43 |
| 821,426 | A | | 5/1906 | Meyer | 24/280 |
| 835,889 | A | | 11/1906 | Moeller | |
| 1,012,219 | A | | 12/1911 | Overton | |
| 1,031,577 | A | | 7/1912 | Overton | |
| 1,080,159 | A | | 12/1913 | Overton | |
| 1,103,666 | A | | 7/1914 | Fife | |
| 1,163,034 | A | | 12/1915 | Phippen | |
| 1,195,338 | A | | 8/1916 | Churchill | 285/44 |
| 1,202,687 | A | | 10/1916 | Elkerton | 285/13 |
| 1,540,192 | A | | 6/1925 | Smith | 285/13 |
| 1,594,932 | A | | 8/1926 | Doyle | |
| 1,678,715 | A | | 7/1928 | Stephenson | |
| 1,721,715 | A | | 7/1929 | Schindler | |
| 1,923,220 | A | | 8/1933 | Lightbown | 285/13 |
| 2,054,308 | A | * | 9/1936 | Tucker | 285/42 |
| 2,069,289 | A | | 2/1937 | Swendsen et al. | 52/288.1 |
| 2,151,794 | A | | 3/1939 | Peebles | |

(Continued)

*Primary Examiner*—Brian E. Glessner
(74) *Attorney, Agent, or Firm*—Standley Law Group LLP

(57) ABSTRACT

The present invention is a boot and a method of making a boot for providing a water-tight seal around a protrusion on a roof. The boot may have a top portion adapted to surround a predetermined portion of the protrusion to be covered. The bottom end of the top portion has a bottom opening and a horizontally flat bottom edge. The boot may be installed by placing the bottom opening of the top portion over a protrusion to be covered so that the base portion is substantially flat on the roof. The top opening of the top portion may then be pulled around the protrusion so that it may be adjusted to fit the protrusion. Then the top opening of the top portion may be sealed around the protrusion and the base portion may be sealed to the roofing membrane.

5 Claims, 20 Drawing Sheets

U.S. PATENT DOCUMENTS 2,176,344 A 10/1939 Hunt
2,256,313 A 9/1941 Dexter
3,040,154 A 6/1962 Marsh ..... 156/539
3,054,222 A 9/1962 Buckner
3,325,953 A 6/1967 Alleaume ..... 52/276
3,446,685 A 5/1969 Goldstone et al. ..... 156/219
3,446,688 A 5/1969 Flax ..... 156/423
3,451,178 A 6/1969 Beale ..... 52/210
3,566,562 A 3/1971 White
3,763,605 A 10/1973 Freeman
3,871,145 A * 3/1975 Hatmaker ..... 52/60
3,887,323 A 6/1975 Bratten ..... 425/521
3,890,754 A 6/1975 Spurdle ..... 52/631
3,894,376 A 7/1975 Shearer
3,942,295 A 3/1976 Schacht ..... 52/288
4,049,034 A 9/1977 Vcelka et al. ..... 150/8
4,112,632 A 9/1978 Simpson
4,115,961 A 9/1978 Bishop ..... 52/58
4,120,129 A 10/1978 Nagler et al. ..... 52/219
4,162,597 A 7/1979 Kelly ..... 52/410
4,192,116 A 3/1980 Kelly ..... 52/469
4,217,742 A 8/1980 Evans
4,223,486 A 9/1980 Kelly ..... 52/1
4,226,069 A 10/1980 Hinds
4,265,058 A 5/1981 Logsdon ..... 52/58
4,302,275 A 11/1981 Burmeister et al. ..... 156/446
4,335,546 A 6/1982 Kelly ..... 52/58
4,351,140 A 9/1982 Simpson ..... 52/542
4,374,695 A 2/1983 Ikeda et al. ..... 156/293
4,382,353 A 5/1983 Kelly ..... 52/506
4,386,488 A 6/1983 Gibbs ..... 52/199
4,389,826 A 6/1983 Kelly ..... 52/410
4,419,067 A 12/1983 Graafmann ..... 425/392
4,441,295 A 4/1984 Kelly ..... 52/408
4,442,643 A * 4/1984 Stadheim ..... 52/219
4,446,665 A 5/1984 Berger ..... 52/407
4,449,336 A 5/1984 Kelly ..... 52/105
4,493,175 A 1/1985 Coppola, Jr.
4,496,410 A 1/1985 Davis et al. ..... 156/84
4,544,593 A 10/1985 Borgert et al. ..... 428/80
4,555,296 A 11/1985 Burtch et al. ..... 156/446
4,557,081 A 12/1985 Kelly ..... 52/94
4,563,847 A * 1/1986 Hasty ..... 52/219
4,603,517 A 8/1986 Lyons, Jr.
4,625,469 A 12/1986 Gentry et al.
4,635,409 A 1/1987 Vandemore
4,642,950 A 2/1987 Kelly ..... 52/90
4,652,321 A 3/1987 Greko
4,668,315 A 5/1987 Brady et al. ..... 156/71
4,671,036 A 6/1987 Sullivan
4,688,361 A 8/1987 Kelly ..... 52/173 R
4,700,512 A 10/1987 Laska ..... 52/58
4,712,348 A 12/1987 Triplett et al.
4,718,211 A 1/1988 Russell et al.
4,726,164 A 2/1988 Reinwall et al.
4,736,562 A 4/1988 Kelly ..... 52/173 R
4,799,986 A 1/1989 Janni
4,834,828 A 5/1989 Murphy ..... 156/359
4,848,045 A 7/1989 Nichols et al.
4,860,514 A 8/1989 Kelly
4,870,796 A 10/1989 Hart et al.
4,872,296 A 10/1989 Janni
4,888,930 A 12/1989 Kelly ..... 52/410
4,897,974 A * 2/1990 Lane ..... 52/199
4,909,135 A * 3/1990 Greko ..... 454/368
4,937,991 A * 7/1990 Orth ..... 52/199
4,947,614 A 8/1990 Mayle ..... 52/717.1
4,963,219 A 10/1990 Nichols et al.
5,010,700 A * 4/1991 Blair ..... 52/199
5,014,486 A 5/1991 Mayle ..... 52/717.1
5,027,572 A 7/1991 Purcell et al.
5,031,374 A 7/1991 Batch et al.
5,065,553 A 11/1991 Magid
5,077,943 A 1/1992 McGady
5,145,617 A 9/1992 Hermanson et al.
5,197,252 A 3/1993 Tiscareno
5,218,793 A 6/1993 Ball
5,365,709 A 11/1994 Lassiter
5,452,553 A 9/1995 Clapp et al.
5,536,048 A * 7/1996 Orr ..... 285/42
5,570,553 A 11/1996 Balkins
5,586,414 A 12/1996 Tawzer
5,605,019 A 2/1997 Maziekien et al.
5,706,610 A 1/1998 Mayle
5,740,647 A 4/1998 Kelly ..... 52/408
5,775,052 A 7/1998 Mayle
5,829,214 A 11/1998 Hart
5,850,719 A 12/1998 Mayle
5,930,969 A 8/1999 Mayle et al.
5,935,357 A 8/1999 Hubbard et al. ..... 156/82
5,970,667 A * 10/1999 Thaler ..... 52/219
5,983,592 A 11/1999 Mayle
6,004,645 A 12/1999 Hubbard ..... 428/57
6,021,616 A 2/2000 Mayle
6,021,620 A * 2/2000 Vermilion et al. ..... 52/741.4
6,110,311 A * 8/2000 Mayle et al. ..... 156/189
6,185,885 B1 * 2/2001 Thaler ..... 52/219
6,187,122 B1 2/2001 Hubbard et al. ..... 156/82
6,199,326 B1 3/2001 Mayle
6,205,730 B1 3/2001 Hasan et al.
6,250,034 B1 6/2001 Hulsey
6,273,145 B1 * 8/2001 Botting ..... 138/166
6,588,801 B1 * 7/2003 Mayle ..... 285/42
6,691,473 B1 * 2/2004 Mayle et al. ..... 52/198

* cited by examiner

FIG-8
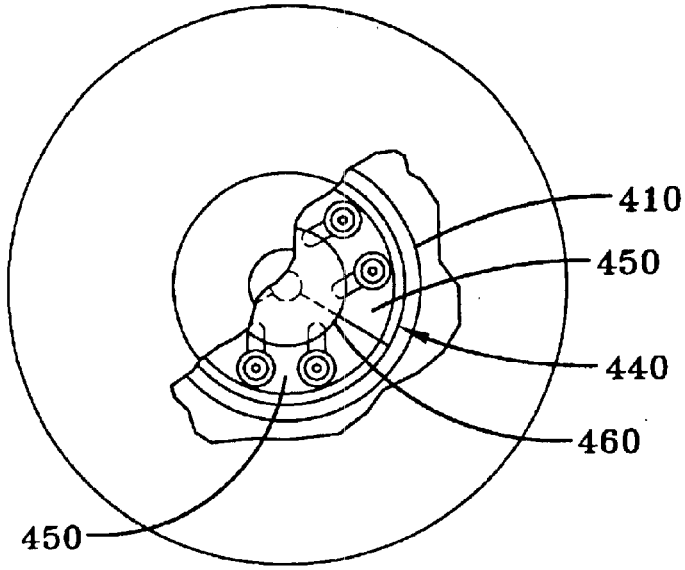
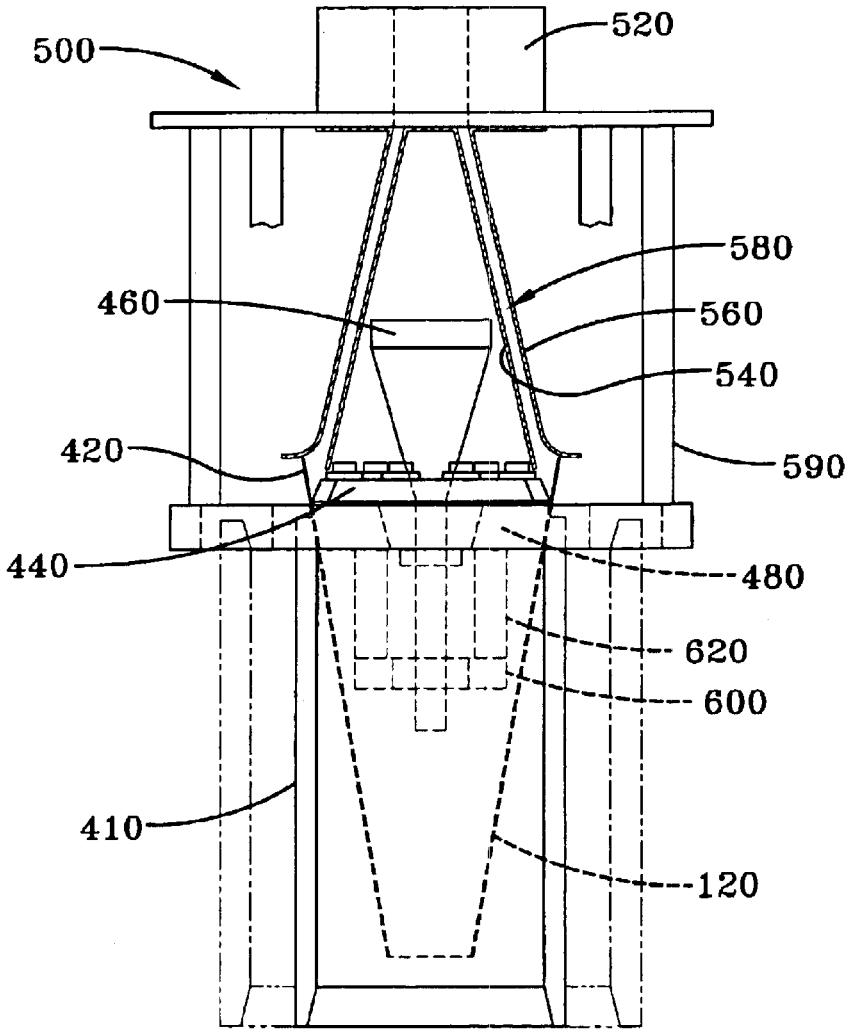
FIG-7

APPARATUS AND METHOD FOR SEALING A VERTICAL PROTRUSION ON A ROOF

This is a utility application claiming priority of provisional Application No. 60/353,251, filed Feb. 1, 2002, which is hereby incorporated by reference in its entirety.

BACKGROUND AND SUMMARY OF THE INVENTION

The present invention relates generally to roof-covering devices, and more particularly to a boot for covering and providing a water-tight seal around a protrusion on a roof.

Polymer coated membranes are commonly used to cover roofs. Often, the membrane is custom designed for the particular roof on which it is used. The roof measurements are provided to the factory which creates a unitary membrane from separate pieces which have been heat welded together.

Although these roofs are generally flat, there are frequently items protruding from the surface of the roof, such as vents, ductwork, air conditioning units, and the like. The size of these items should be provided to the factory so that accommodations can be made for them in the membrane. Locations of these items at certain points on the roof may also be provided to the factory.

The present invention specifically relates to a boot for covering and sealing a vertical protrusion (e.g., pipe) extending from a roof to be sealed. As discussed, when installing a roof membrane, it is desirable to provide a water-tight seal around protrusions in a roof. Typically, when installing a boot around a protruding pipe, generally three seals are made to provide a water-tight seal around the pipe:

1.) a base portion of the boot should be sealed to a top portion of the boot (e.g. hot air sealed, welded, glued, or caulked);

2.) the base portion should be sealed to the roof or a roof membrane that may be formed of the same or similar material as the base portion, or another material that may be heat bonded or otherwise sealed with the base portion in a leak proof manner (e.g. hot air sealed, welded, glued, or caulked); and 3.) a top end of the top portion of the boot should be sealed around the pipe to prevent water from entering any space between the boot and the pipe.

Currently this process of sealing a protruding pipe takes a relatively long time and can result in a poor seal. Accordingly, the present invention relates to a new method and apparatus for sealing vertical protrusions on a roof allowing the boot of the present invention to be relatively easily installed and adjusted to provide a tight seal for protruding pipes.

The boot of the present invention may be preferably comprised of: a top portion adapted to surround a predetermined portion of the protrusion (e.g., pipe) to be covered, the top portion having a top end and a bottom end, wherein the top end has a top opening and wherein the bottom end has a bottom opening; a base portion, wherein the base portion may be connected to a bottom edge of the top portion and wherein the top portion may extend substantially in the vertical direction when the base portion resides on the roof. It is also preferred that the bottom opening of the boot be adapted to accept a protrusion (e.g., pipe) to be covered. In an exemplary embodiment, the top end of the top portion may have a slit, the slit running vertically down a predetermined distance of the top portion of the boot and wherein the slit allows the top opening of the top portion to be adjusted in size to fit around various sizes of pipe to be sealed.

In another exemplary embodiment of the present invention, the top portion may be used without a base in certain situations.

The boot of the present invention may preferably be formed by: providing a first piece of material having a first side edge and a second side edge; forming a top portion having a bottom opening and top opening and a slit portion at a top end of the top portion, said top portion formed by sealing a bottom portion of the first side edge to a corresponding bottom portion of the second side edge; heating and then compressing the bottom edge of the top portion so that the bottom edge turns horizontally outward forming a flat horizontal circumference around the entire bottom of the top portion; providing a base portion; and sealing a bottom edge of the top portion with the base portion so that the top portion may be substantially vertical with respect to the base portion when the base is in the flat horizontal position.

In one embodiment, the bottom edge of the top portion may be folded and positioned around the edge or perimeter of the opening in the base portion. The bottom edge of the top portion may then be welded to the base portion to form a weld that may be substantially flat on the same plane as the base portion. This weld allows the base portion to lay substantially flat during the welding process obviating the need to deform the edge of the base opening to accomplish the weld. In this embodiment, the bottom edge of the top portion may overlap the perimeter of the opening of the base portion or the perimeter of the opening of the base portion may overlap the bottom edge of the top portion when welded.

In an alternative embodiment, the edge of the base portion may be folded up to make a lapped engagement with the vertical portion of the top portion. Accordingly, a weld may be made along the substantially flat base portion as well as the vertical top portion to provide a strong seal (i.e., welded).

In yet another embodiment, the top portion may be used without a base. Particularly, when the bottom edge of the top portion is turned out with a sufficient width that a seal may be formed with the roof or roofing membrane, then a base may not be needed. In this embodiment, the bottom edge may be of such a sufficient width that it may serve as a base. Top portions may be sized at the factory to fit particular sizes of pipes on roofs, or the top portions may comprise a slit near their top for adjustments to fit different sizes of pipes.

The boot may then be installed by: placing the bottom opening of the top portion over a protrusion to be covered; placing the base portion (if it has a base portion) flat over the roof; pulling a top portion of a side edge of the vertical portion around the protrusion (e.g., pipe) so that the top opening of the top portion may be adjusted to fit the protrusion; sealing the top opening of the top portion around the protrusion; and sealing the base portion to the roof or roofing membrane. If an embodiment is used without a base, the bottom edge of the top portion that has been turned out to a sufficient width may be sealed directly to the roof or roofing membrane.

In another open boot flashing embodiment, the flashing may be open to allow the flashing or "stack" to be wrapped around the protrusion to be covered. After wrapping the protrusion, the top and base portions are welded to complete the seal. The open flashing may preferably be comprised of:

a base portion having an opening; a top portion attached to the base portion along the opening in the base portion; a break in the base portion and the top portion, the break in the base portion separating a first portion of the base portion from a second portion of the base portion, and wherein the break in the top portion separates a first portion of the top portion from a second portion of the top portion; and wherein the break allows the apparatus to be opened to accept a protrusion on the roof to be covered and wherein the first portions of the base portion and the top portion may be pulled around the protrusion and sealed to the second portions of the base portion and top portion, respectively. The first portions of the base portion and top portion may be adjustably pulled around the protrusion to accommodate protrusions of various sizes.

In one embodiment, the bottom edge of the top portion may be folded and positioned around the edge or perimeter of the opening in the base portion. The bottom edge of the top portion may then be welded to the base portion to form a weld that may be substantially flat on the same plane as the base portion. This weld allows the base portion to lay substantially flat during the welding process obviating the need to deform the edge of the base opening to accomplish the weld. In this embodiment, the bottom edge of the top portion may overlap the perimeter of the opening of the base portion or the perimeter of the opening of the base portion may overlap the bottom edge of the top portion when welded.

In an alternative embodiment, the interior edge of the base portion may be folded vertically straight up to make a lapped engagement with the vertical wall of the top portion. Accordingly, a weld may be made along the overlapped portions to provide a strong weld.

A flat edge having sufficient width formed at the bottom of the top portion may be formed by placing the top portion into a die, with a portion of the material sticking out. A seal forming cone and handle may be inserted into the top portion. This material sticking out above the die may then be heated for a sufficient time to disrupt the molecules in the material, thereby allowing the material to expand. The handle may then be placed in its locking position, extending the members that may resemble pie sections of the seal forming cone and pushing the material outward so that a horizontally flat circumference (i.e. bottom edge with sufficient width) may be formed.

In addition to the novel features and advantages mentioned above, other objects and advantages of the present invention will become readily apparent to those skilled in the art from reading the following detailed description of the drawings and exemplary embodiments.

BRIEF DESCRIPTION OF THE DRAWINGS

FIG. 7 illustrates a side view of an exemplary embodiment of the device used in the method of making the bottom edge of the boot of the present invention.

FIG. 8 illustrates a top view of a die showing three different die sections of the device of FIG. 7.

DETAILED DESCRIPTION OF PREFERRED EMBODIMENT(S)

The exemplary systems herein described are not intended to be exhaustive or to limit the invention to the precise forms disclosed. They are chosen and described to explain the principles of the invention, and the application of the method to practical uses, so that others skilled in the art may practice the invention.

U.S. patent application Ser. No. 09/759,698 is incorporated by reference herein.

Figure 1:
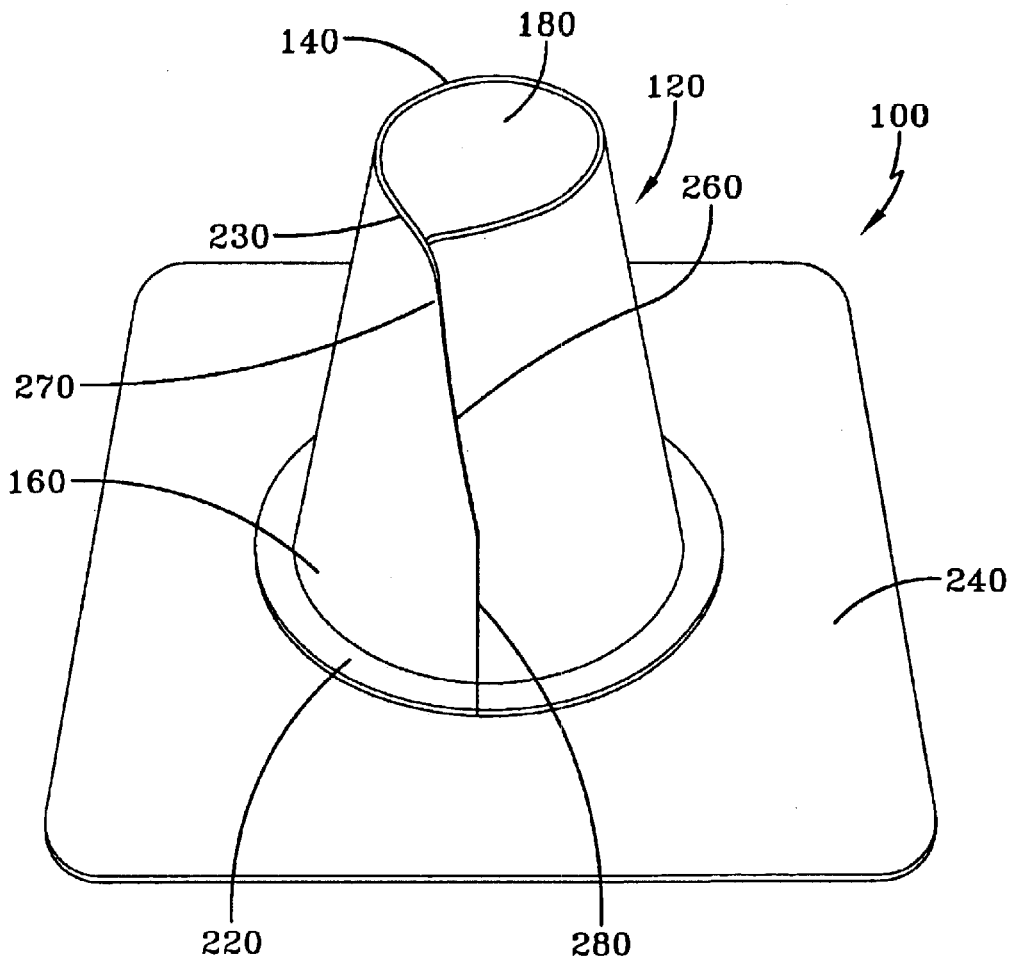
FIG. 1 illustrates a perspective view of one embodiment of the boot of the present invention.

FIG. 1 illustrates one embodiment of the boot 100 of the present invention. In an exemplary embodiment, the boot 100 of the present invention may be adapted to seal protrusions, such as pipes, on a roof. In an exemplary embodiment, the boot of the present invention may be comprised of:

a top portion 120 adapted to surround a predetermined portion of a protrusion (e.g., pipe) to be covered, the top portion 120 having a top end 140 and a bottom end 160, wherein the top end 140 has a top opening 180 and wherein the bottom end 160 has a bottom opening 200 (see FIG. 3*a*); and a base portion 240, wherein the base portion 240 may be connected to a bottom edge 220 of the top portion 120 and wherein the top portion 120 extends substantially in the vertical direction when the base portion 240 resides on the roof.

In one embodiment, the bottom edge 220 of the top portion 120 may also be folded and positioned around the edge or perimeter of an opening 400 (see FIG. 4) in the base portion 240. The bottom edge 220 of the top portion 120 may then be welded to the base portion 240 around the opening 400 to form a weld that may be substantially flat on the same plane as the base portion 240. This weld allows the base portion 240 to lay substantially flat during the welding process obviating the need to deform the edge 405 (see FIG. 4) of the base opening 400 to accomplish the weld.

In an alternative embodiment, the edge 405 of the base opening 400 may be folded up to make a lapped engagement with the vertical wall of the top portion. Accordingly, a weld may be made along the overlapped material to provide a strong leak-proof seal.

In an exemplary embodiment, the top end 140 of the top portion 120 may have a slit 260 (not welded at the factory), the slit 260 running vertically down a predetermined distance of the top portion 120 of the boot 100 and wherein the slit 260 allows the top opening 180 of the top portion 120 to be adjusted in size to fit around the protrusion (e.g., pipe) to be covered. It is preferred that the slit 260 extend about 2 inches from a top edge 230 of the top portion 120 to allow flexibility for the top opening 180 to be adjusted in size. The top opening 180 may be made smaller by pulling the "flap" portion 270 of the top portion 120 around the pipe. ("Flap" in this instance merely refers to an overlapping section 270 of the top portion 120 that is not sealed at the factory.)

Figure 2:
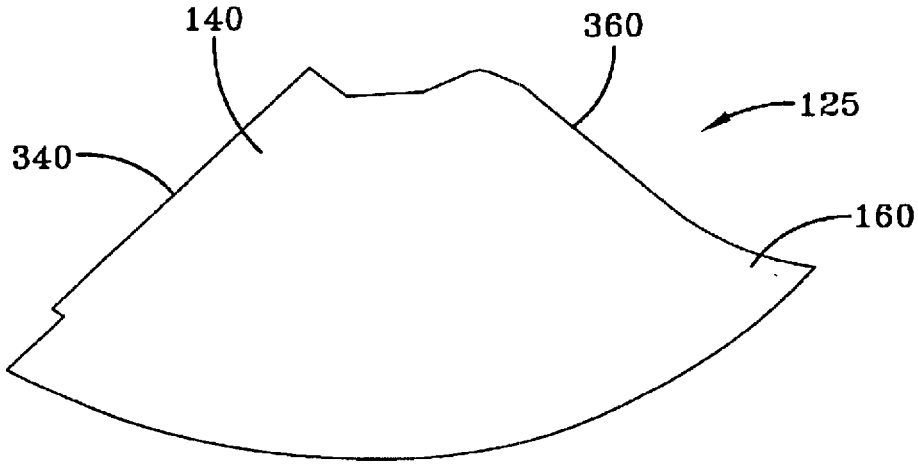
FIG. 2 illustrates a perspective view of one embodiment of an unassembled top portion of the boot of FIG. 1.

FIG. 2 illustrates one embodiment of a material blank 125 used to form the top portion 120 of the boot 100 of FIG. 1. The material blank 125 may have a first side edge 340 and a second side edge 360. A conical shaped top portion 120 may be formed from the unassembled top portion 320 when the first side edge 340 and the second side edge 360 are sealed together (see FIG. 3*a*). In an exemplary embodiment, the first side edge 340 may be heat welded to the second side edge 360 forming a heat welded section 280 on the assembled top portion 120. The first and second side edges 340, 360 of the top portion 120 may be heat welded along a predetermined portion of the bottom end 160 of the top portion 120, whereafter the unattached sections of the first and second side edges 340, 360 form the slit 260. The bottom circumference of the top portion 120 may then be heated, thereby expanding the molecules of the material, and expanding the material itself, thereby forming a bottom edge 220 that may be substantially perpendicular to the axis of the conical shaped top portion 120.

Figure 3A:
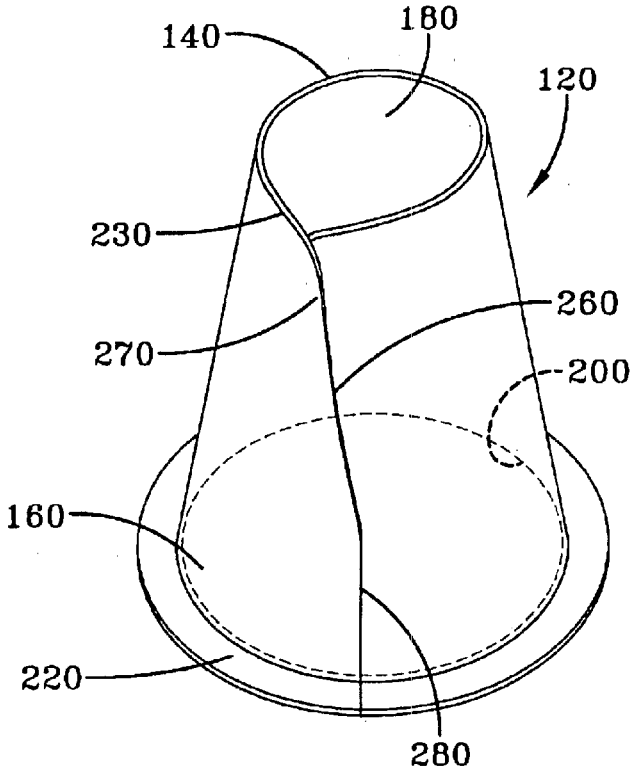
FIG. 3*a* illustrates a perspective view of one embodiment of an assembled top portion of the boot of FIG. 1.
Figure 3B:
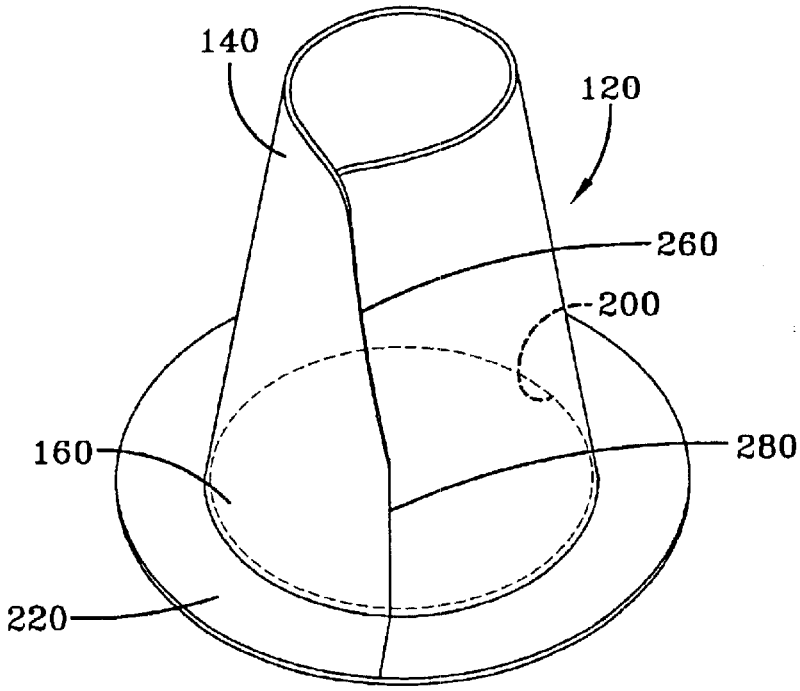
FIG. 3*b* illustrate a perspective view of one embodiment of an assembled top portion of the boot of FIG. 1 having a bottom edge of a greater width, which may also be used without a base portion.

FIGS. 3*a* and 3*b* illustrate embodiments of an assembled top portion 120 of the boot of FIG. 1. As the top portion 120 may be cone shaped, the top opening 180 may be smaller than the bottom opening 200. However, in another embodiment, the top portion 120 may be substantially cylindrical in shape, whereby the top opening 180 and the bottom opening 200 may be substantially similar in size.

Figure 4:
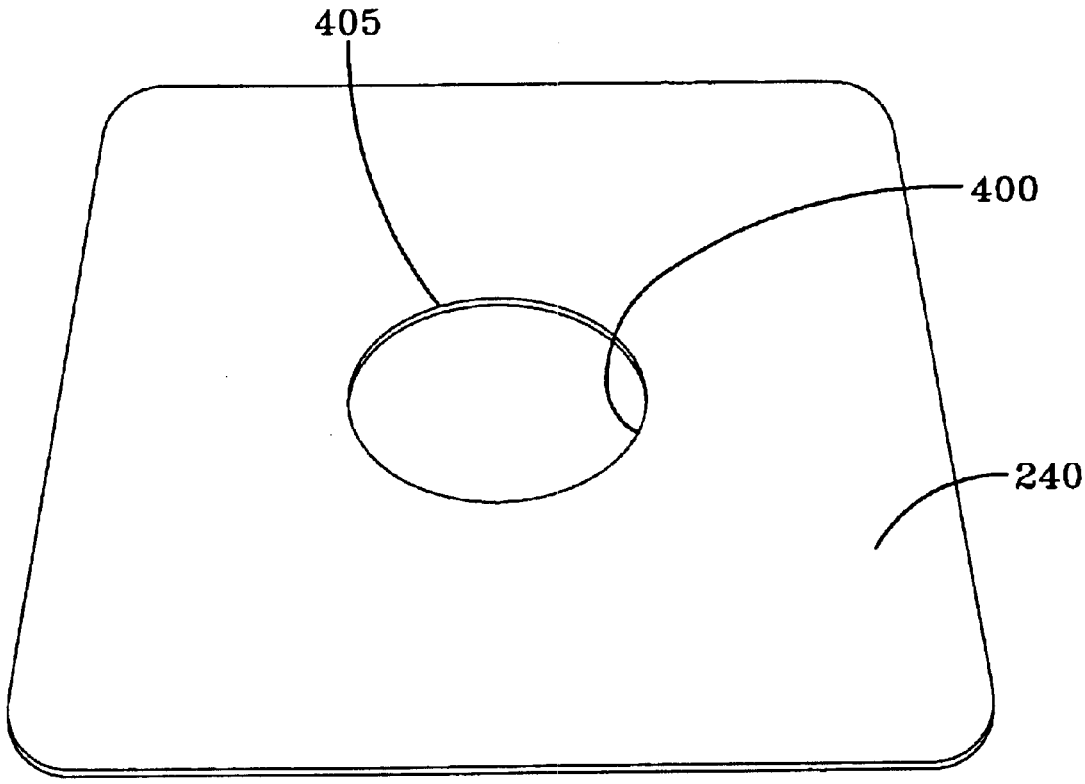
FIG. 4 illustrates a perspective view of one embodiment of a base portion of the boot of FIG. 1.
Figure 5A:
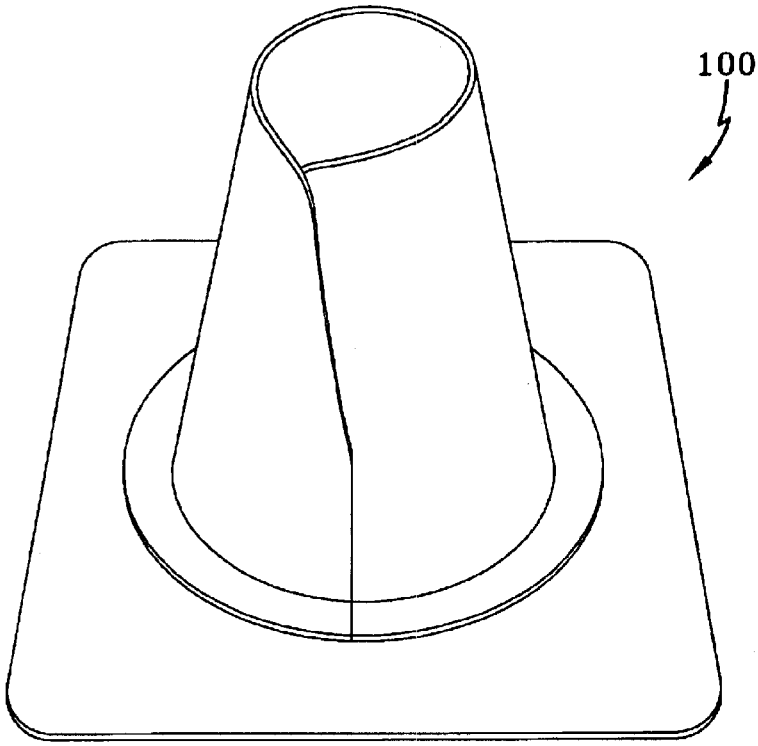
FIG. 5*a* illustrates a perspective view of another embodiment of the boot of the present invention, where the bottom edge of the top portion overlays the base.
Figure 5B:
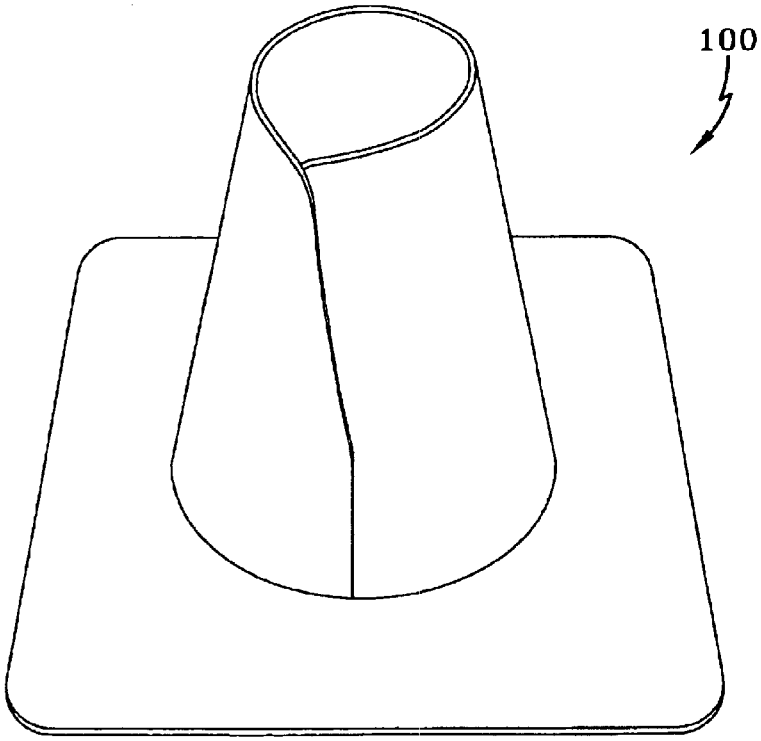
FIG. 5*b* illustrates a perspective view of another embodiment of the boot of the present invention, where the base portion overlays the bottom edge of the top portion.

FIG. 4 illustrates one embodiment of a base portion 240 of the boot 100 of FIG. 1. In an exemplary embodiment, the base portion 240 may be heat welded to the bottom edge 220 of the top portion 120. The base portion 240 and top portion 120 may be formed together using dies (e.g. female and male counterpart dies where the male part may be a cylindrical shaped piece for forming the top portion 120 around the base portion 240). In this embodiment, the bottom edge 220 of the top portion 120 may overlap the perimeter of the opening 400 of the base portion 240 or the perimeter of the opening 400 of the base portion 240 may overlap the bottom edge 220 of the top portion 120 when welded, as shown in FIG. 5*a* and 5*b*, respectively.

The boot 100 of the present invention may preferably be made by first providing a material blank 125 for forming the top portion 120, the material blank 125 having a first side edge 340 and a second side edge 360. The top portion 120 may be formed by sealing a bottom portion of the first side edge 340 to a corresponding bottom portion of the second side edge 360. This seal is shown at 280. The top portion 120 may have a slit 260 at a top end 140 of the top portion 120 and a bottom and top opening 180, 200. In an exemplary embodiment of the boot 100, the top portion 120 may be conical in shape. In another exemplary embodiment of the boot 100, the top portion 120 may be cylindrical in shape.

Figure 11A:
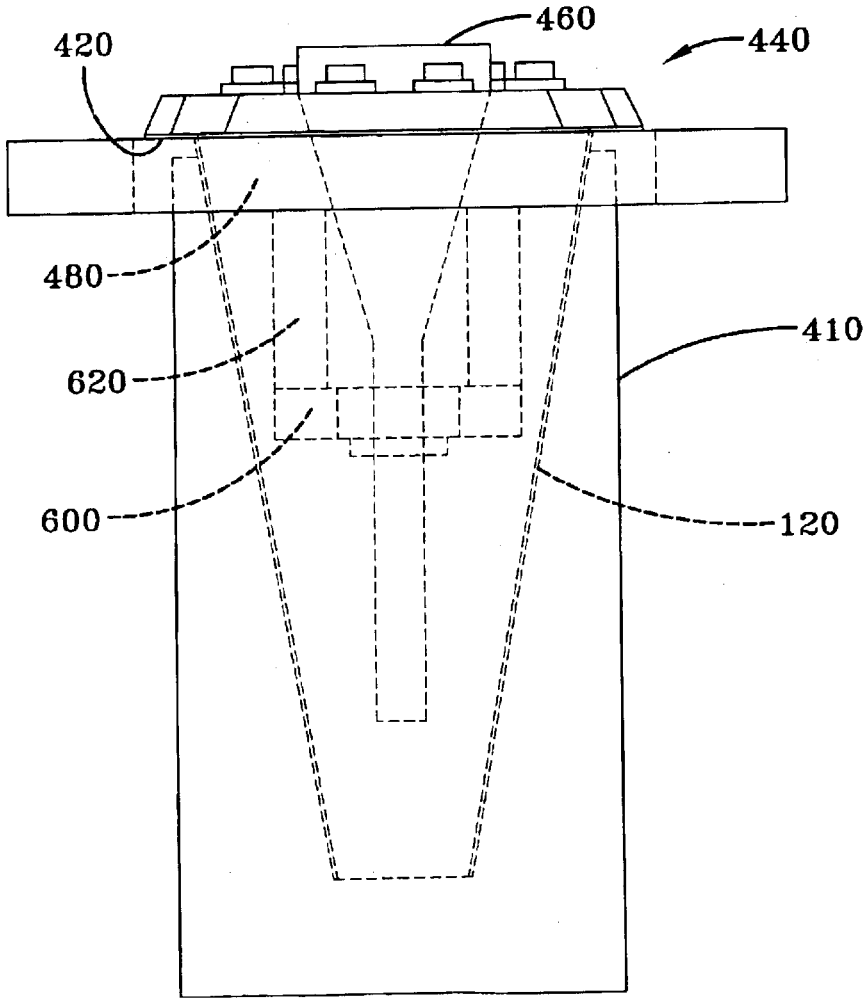
FIG. 11*a* illustrates a side view of the die of the device of FIG. 7 with the handle in the locked position.
Figure 11B:
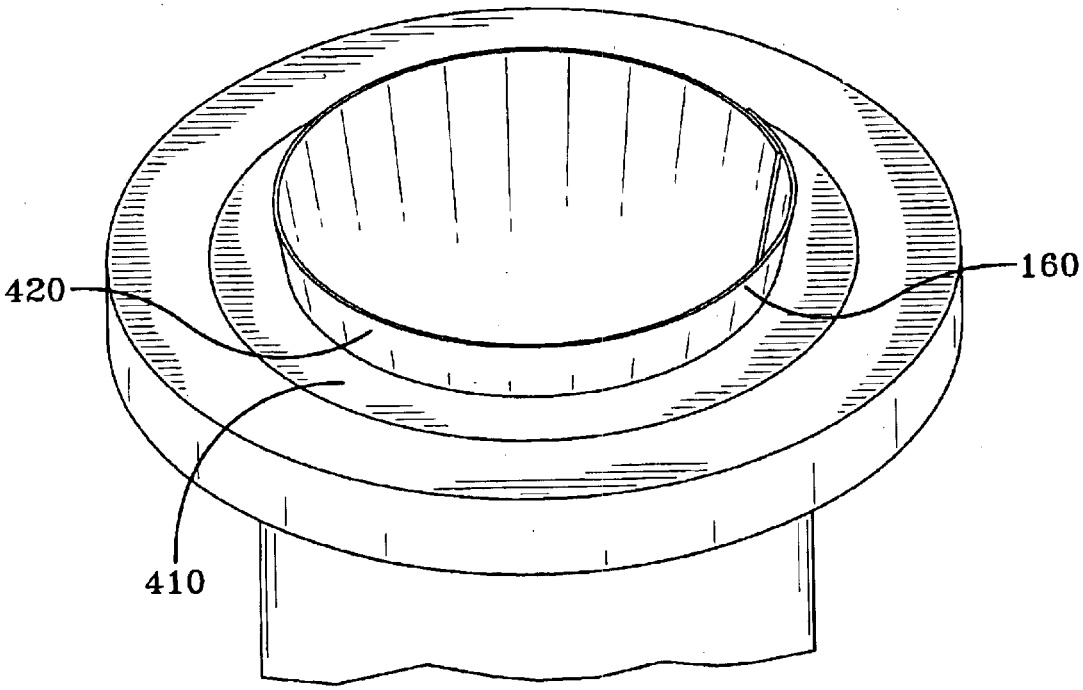
FIG. 11*b* illustrates a perspective view of the die of the device of FIG. 7 with a cone-shaped top portion inside the die.

The top portion 120 may then be inserted into a die 410 with a portion of the material 420 at the bottom end 160 of the top portion 120 protruding therefrom, as shown in FIGS. 7 and 11*b*. In an exemplary embodiment, five-eighths of an inch of the material 420 may protrude from the die 410. In another exemplary embodiment, an inch and a half or greater of the material 420 may protrude from the die 410. However, various widths of the material 420 may be made to protrude from the die 410, as required to produce various embodiments of the boot of the present invention.

Figure 11C:
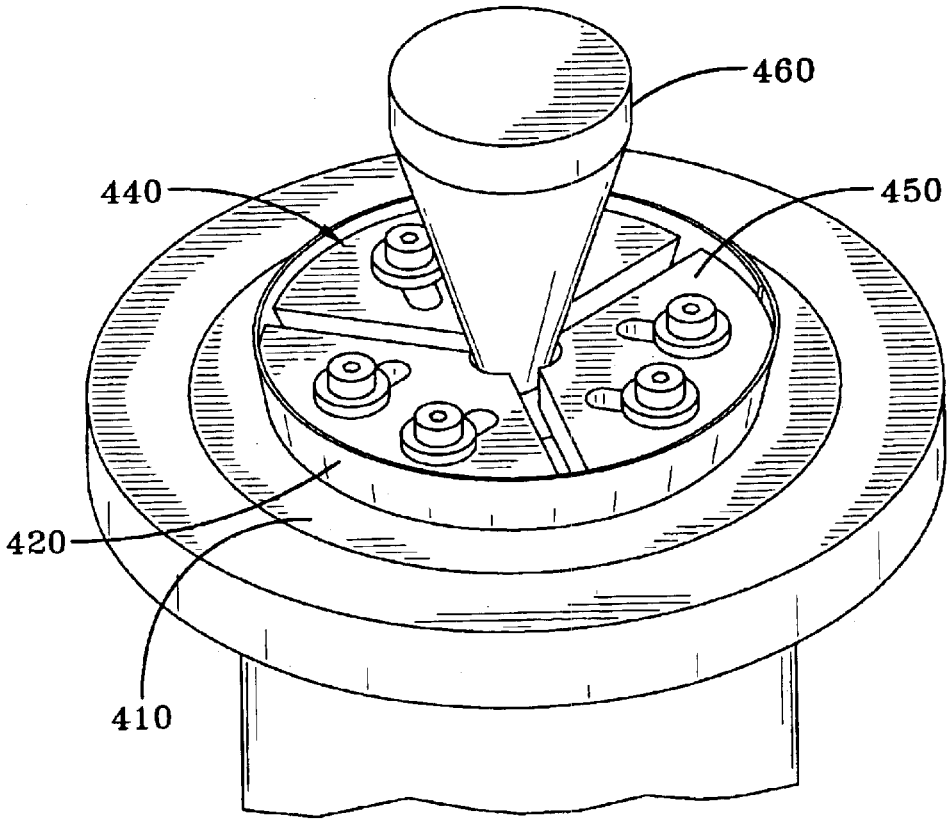
FIG. 11*c* illustrates a perspective view of the die of the device of FIG. 7 with the handle and seal forming cone inserted into the cone-shaped top portion.

Next, the seal forming cone 440 and handle 460 may be inserted into the inverted cone, i.e., top portion 120, as shown in FIG. 11*c*. The seal forming cone 440 and handle 460 initially compresses the protruding material 420 between the cap 480 (see FIG. 7) and the inner wall of the die 410. Next, the material 420 may be heated by any number of heating devices on either its outside or inside surface, or on a combination of both sides thereof.

In an exemplary embodiment, one type of heating device may be a heat gun and cone bracket assembly 500, which may be installed on top of the die 410 with the inserted seal forming cone 440 and handle 460 configuration, as shown in FIG. 7. Heat may then be funneled from a heat gun mount 520, through the channel 580 formed between the inner cone 540 and the outer cone 560, and to the entire circumference of the protruding material 420. The protruding material 420 may be heated for a sufficient amount of time to disrupt the molecules therein, and to allow the material 420 to expand in order to enable the horizontally flat circumference of the bottom edge 220 to be formed. The heating device, in this embodiment the heat gun and cone bracket assembly 500, may then be removed.

Figure 9A:
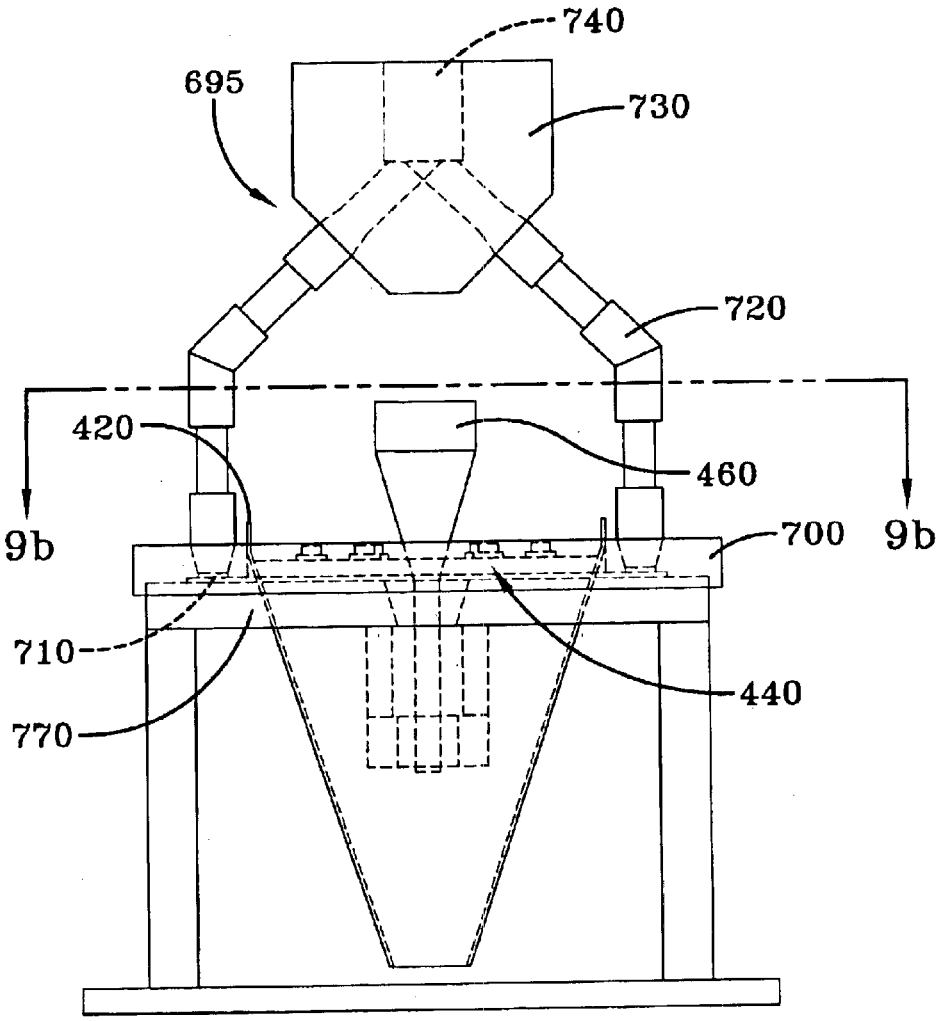
FIGS. 9*a* and 9*b* illustrate a side view and a top view, respectively, of another embodiment of a heating apparatus that may be used in forming a bottom edge on a top portion of a boot.
Figure 9B:
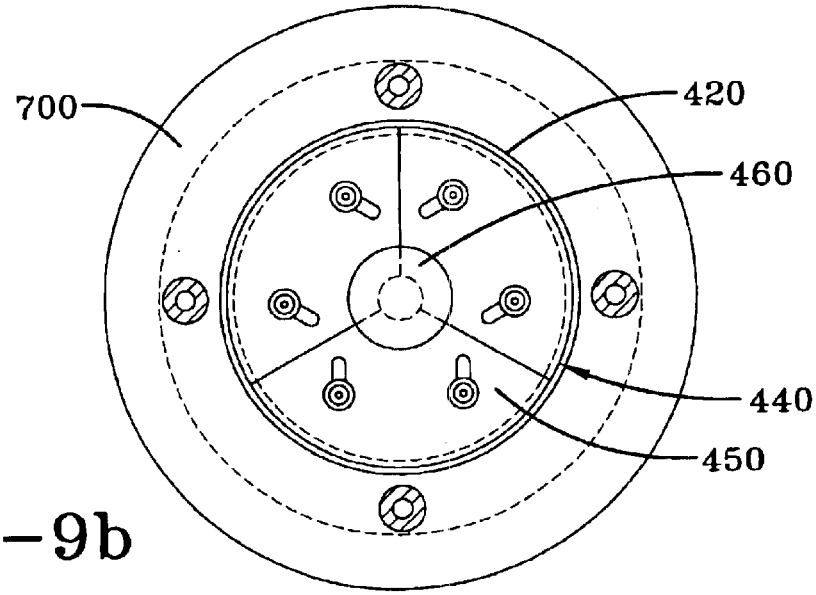
Figure 10:
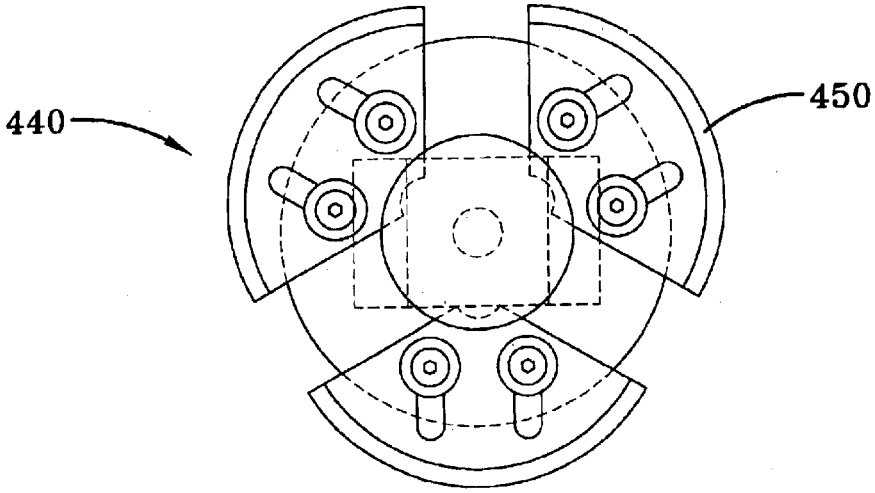
FIG. 10 illustrates expanded, members (in the shape of pie sections) of a seal forming cone of the device of FIG. 7.

In another embodiment, another type of heating device 695 that may be used is shown in FIGS. 9*a* and 9*b*. This heating device 695 may have a circular member 700, having a continuous channel 710. The circular member 700 may preferably be fitted around the protruding material 420 of the top portion 120. The circular member 700 may have a lower end of at least one, and preferably two or three, substantially hollow arms 720 attached thereto. The upper end of the arms 720 may then join together at a joining member 730, allowing the passageway within each arm to communicate with an opening 740 located therein. A hot air source (not shown), such as, but not limited to, a hot air gun, may be placed in or near the opening 740 of the joining member 730. Hot air is funneled from the hot air source, through the opening 740 of the joining member 730, and through the arms 720 to the continuous channel 710 of the circular member 700. The protruding material 420 of the top portion 120 may then be heated by the hot air for a sufficient time to disrupt the molecules thereof, and to allow the material 420 to expand in order to enable the horizontally flat circumference of the bottom edge 220 to be formed. Once the protruding material 420 is heated, the heating device 695 may be removed. FIG. 9*a* also shows that this type of heating device 695 may be used with the top portion 120 held inside a holding member 770 instead of a die 410.

Figure 11D:
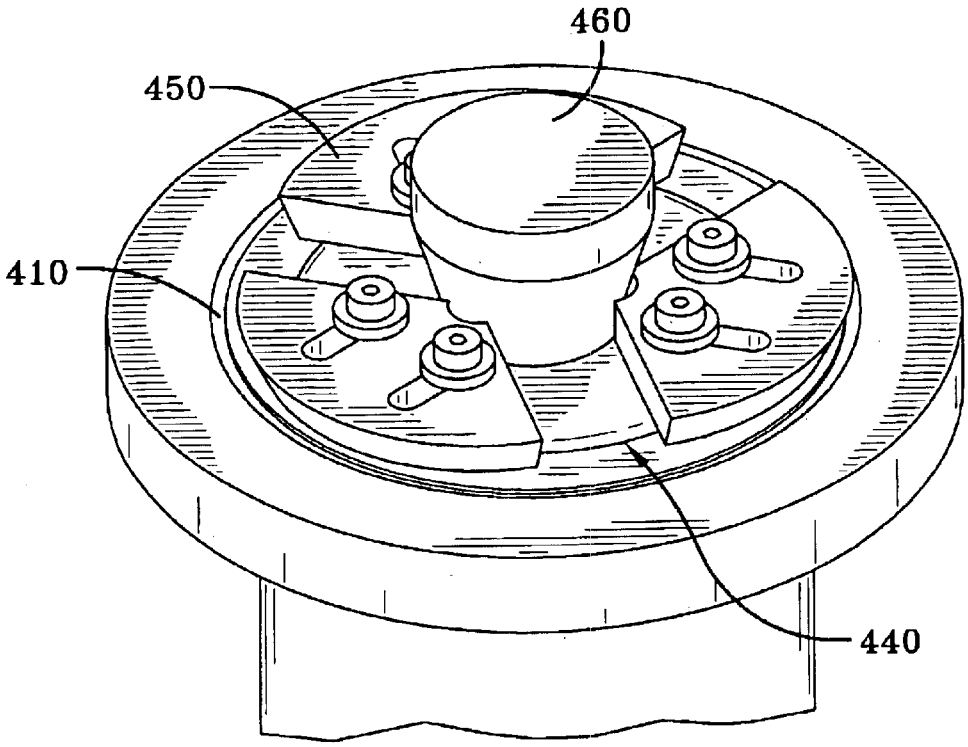
FIG. 11*d* illustrates a perspective view of the die of the device of FIG. 7 with the handle and seal forming cone in its locked position, thereby expanding the moveable sections (i.e., pies) of the seal forming cone.
Figure 11E:
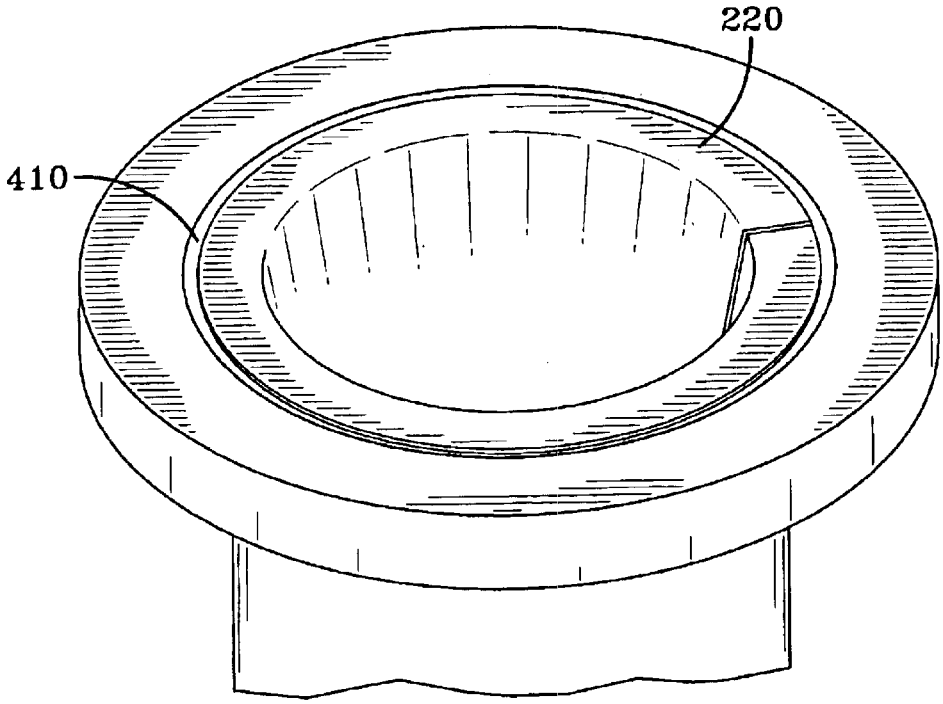
FIG. 11*e* illustrates a perspective view of the die of the device of FIG. 7 with the seal forming cone and handle removed after the bottom edge of the top portion has been formed.
Figure 12:
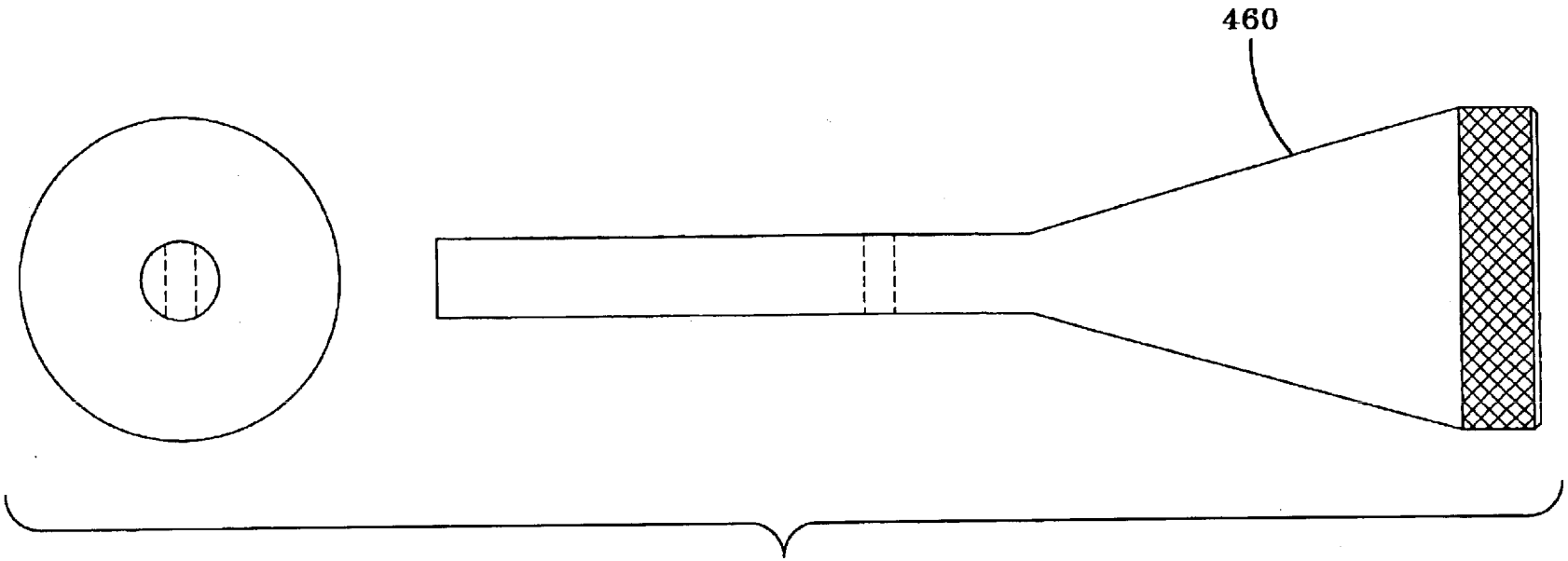
FIG. 12 illustrates a side view and bottom view of the handle of FIG. 7.
Figure 13A:
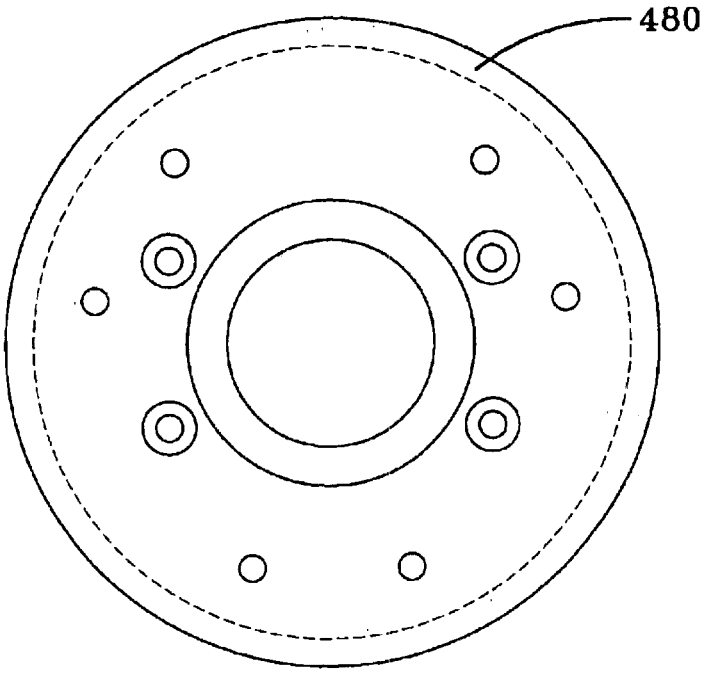
FIGS. 13*a* and 13*b* illustrate a top view and a side view of the cap of FIG. 7, respectively.
Figure 13B:
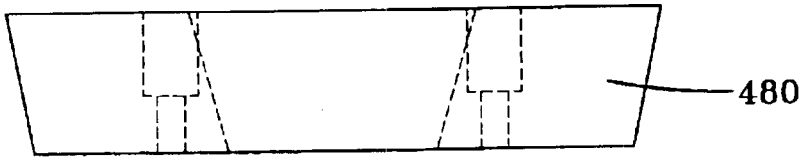
Figure 14A:
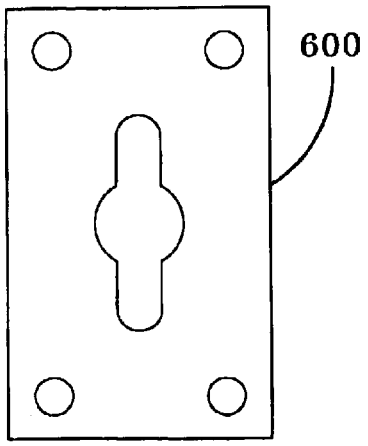
FIGS. 14*a* and 14*b* illustrate a top view and a side view of the lock plate of FIG. 7, respectively.
Figure 14B:
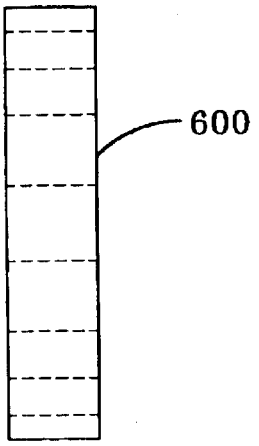
Figure 15A:
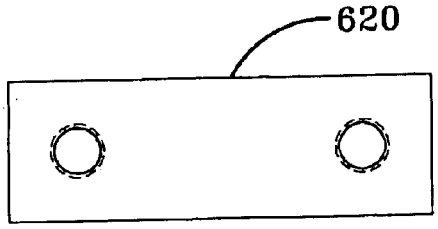
FIGS. 15*a* and 15*b* illustrate a top view and a side view of the lock plate mount of FIG. 7, respectively.
Figure 15B:
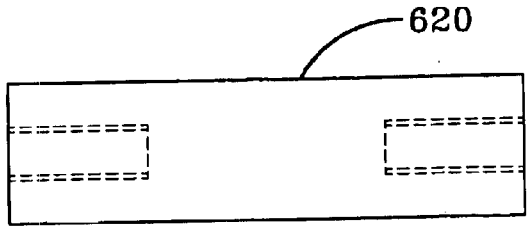
Figure 16A:
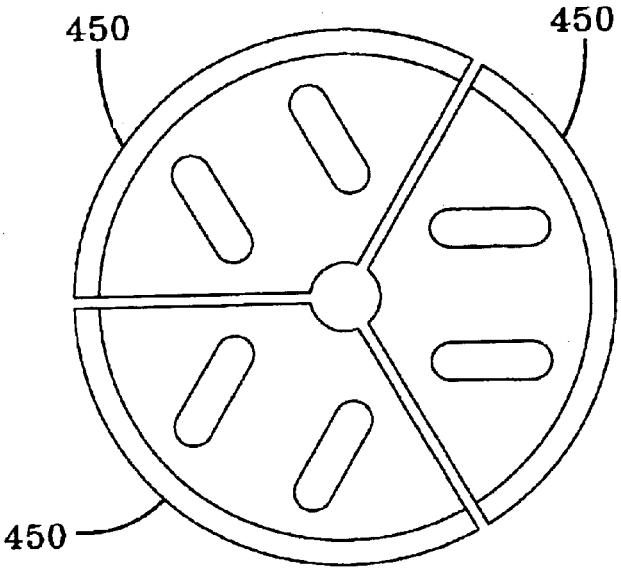
FIGS. 16*a* and 16*b* illustrate a top view and a side view of the seal forming cone of FIG. 7, respectively.
Figure 16B:
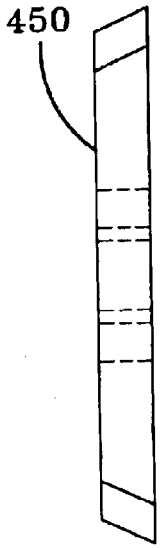
Figure 16C:
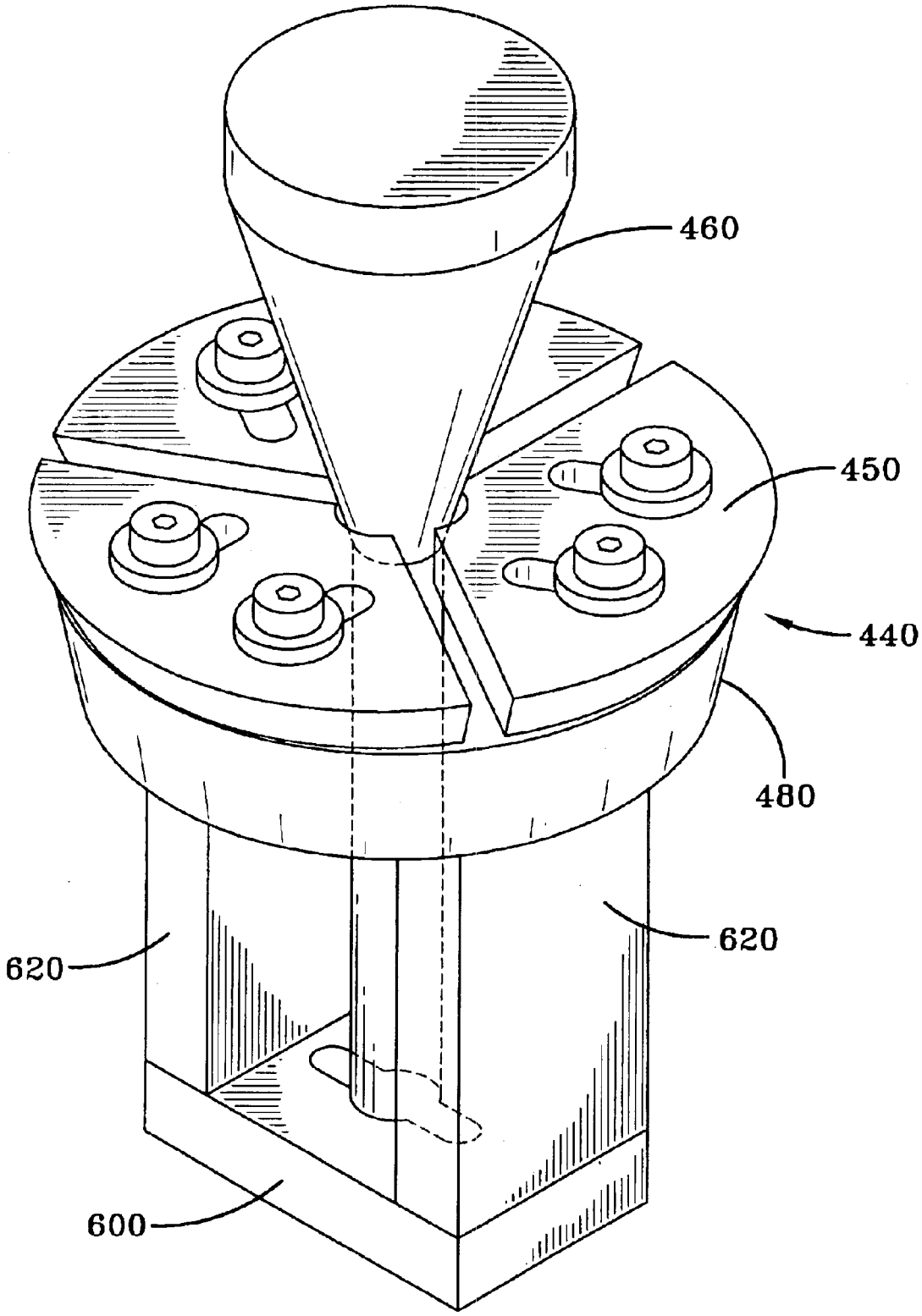
FIG. 16*c* illustrates a perspective view of the seal forming cone and handle combination of FIG. 7.
Figure 17A:
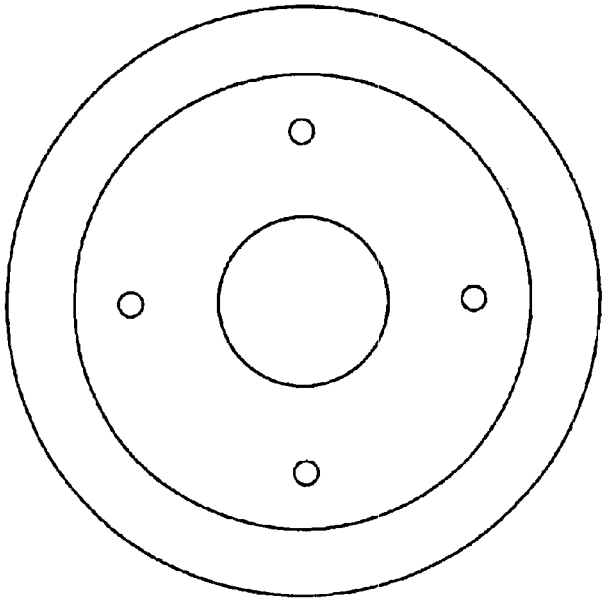
FIGS. 17*a* and 17*b* illustrate a top view and a side view of the outer cone of FIG. 7, respectively.
Figure 17B:
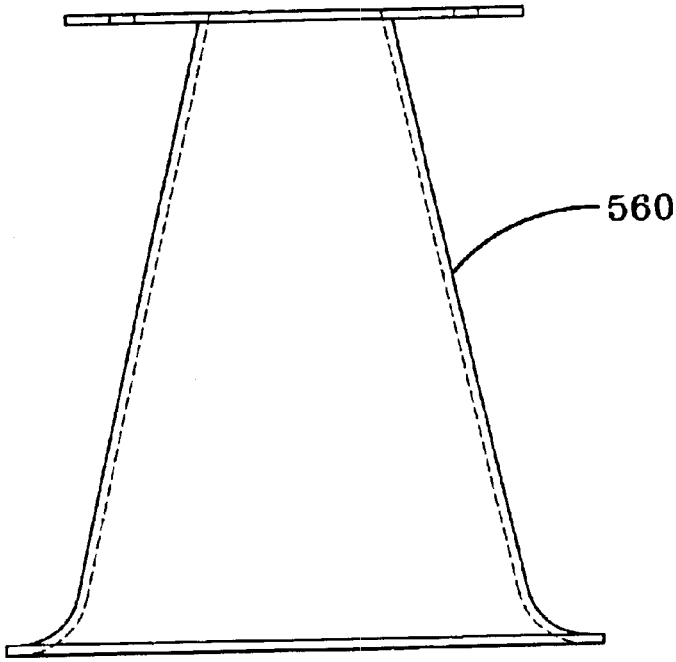
Figure 18A:
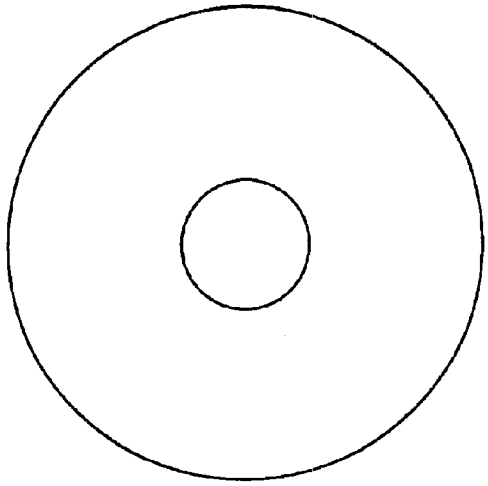
FIGS. 18*a* and 18*b* illustrate a top view and a side view of the inner cone of FIG. 7, respectively.
Figure 18B:
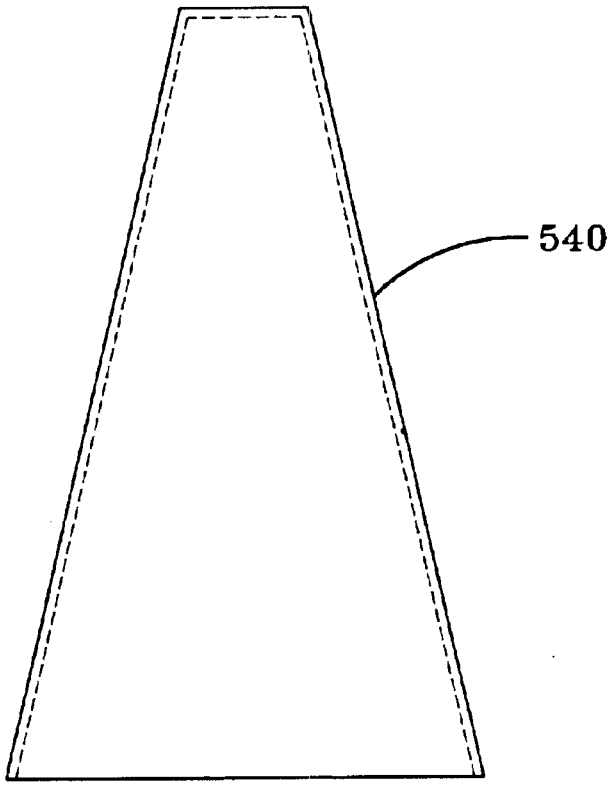
Figure 19A:
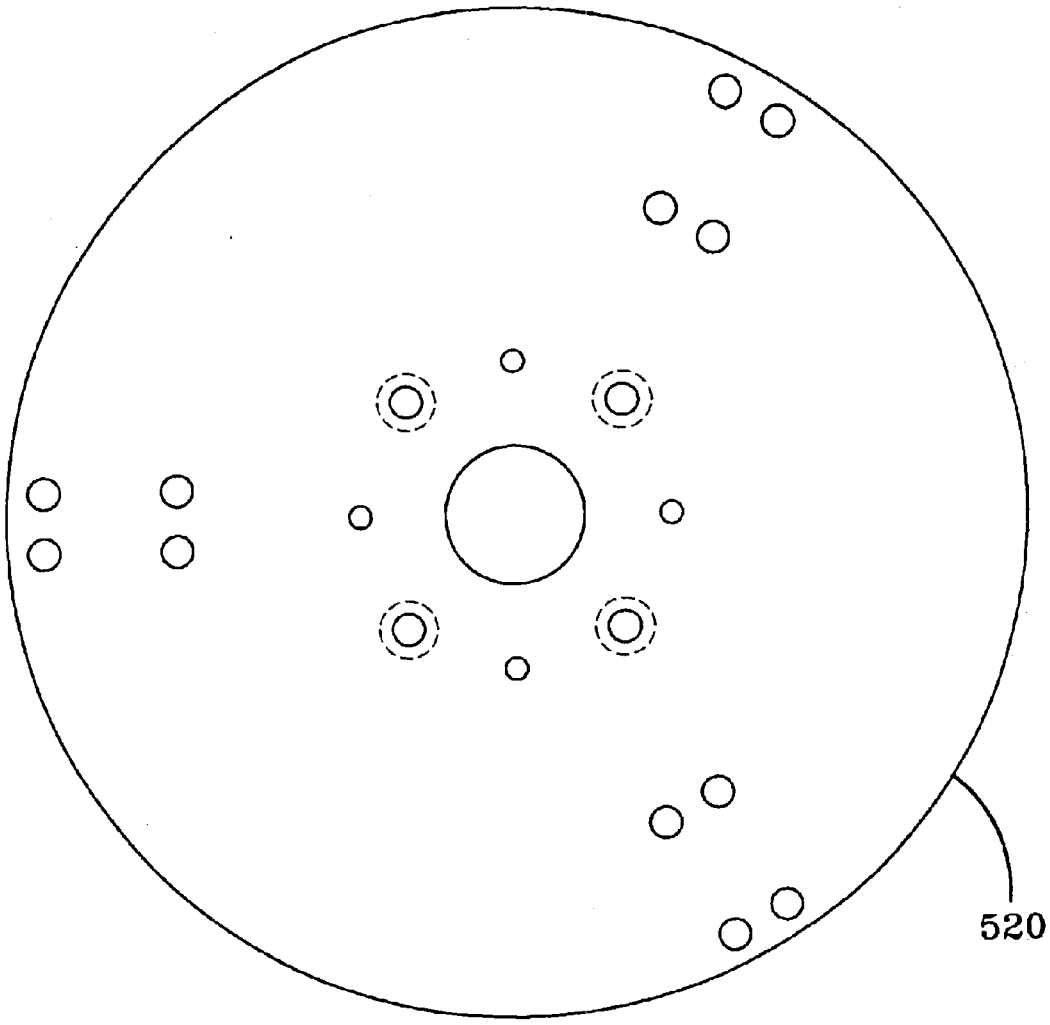
FIGS. 19*a*, 19*b*, 19*c*, 19*d* and 19*e* illustrate top views and side views of the components of the heat gun mount of FIG. 7.
Figure 19B:
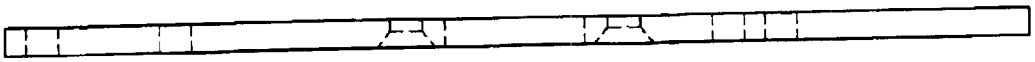
Figure 19C:
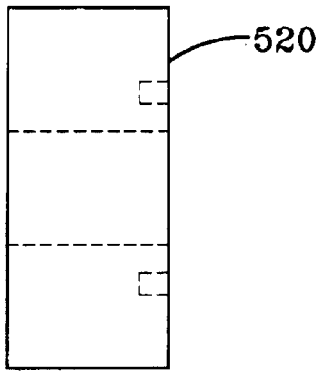
Figure 19D:
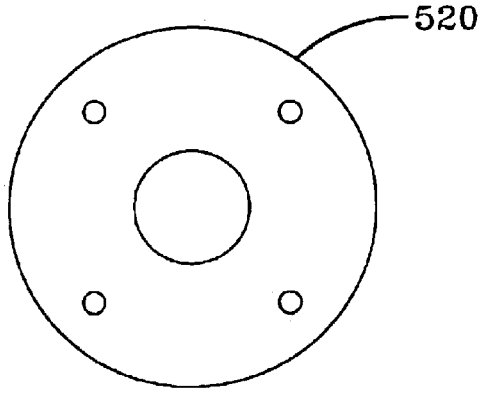
Figure 19E:
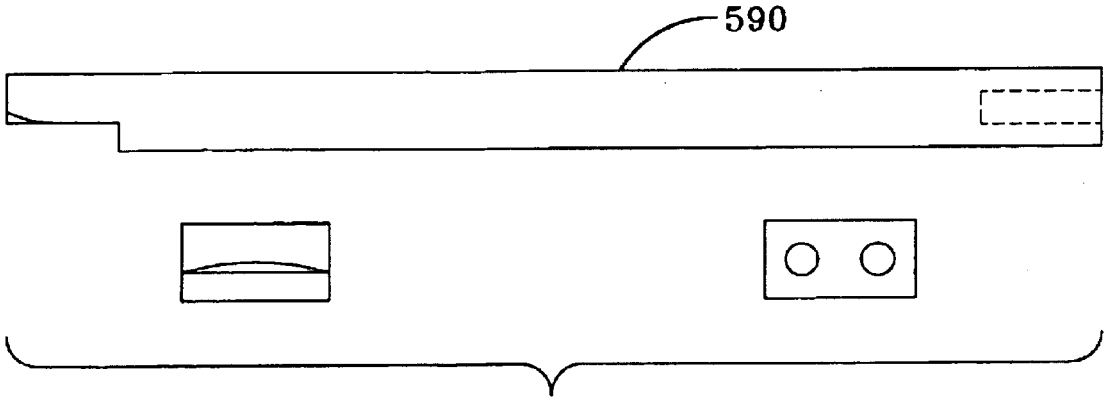
Figure 20:
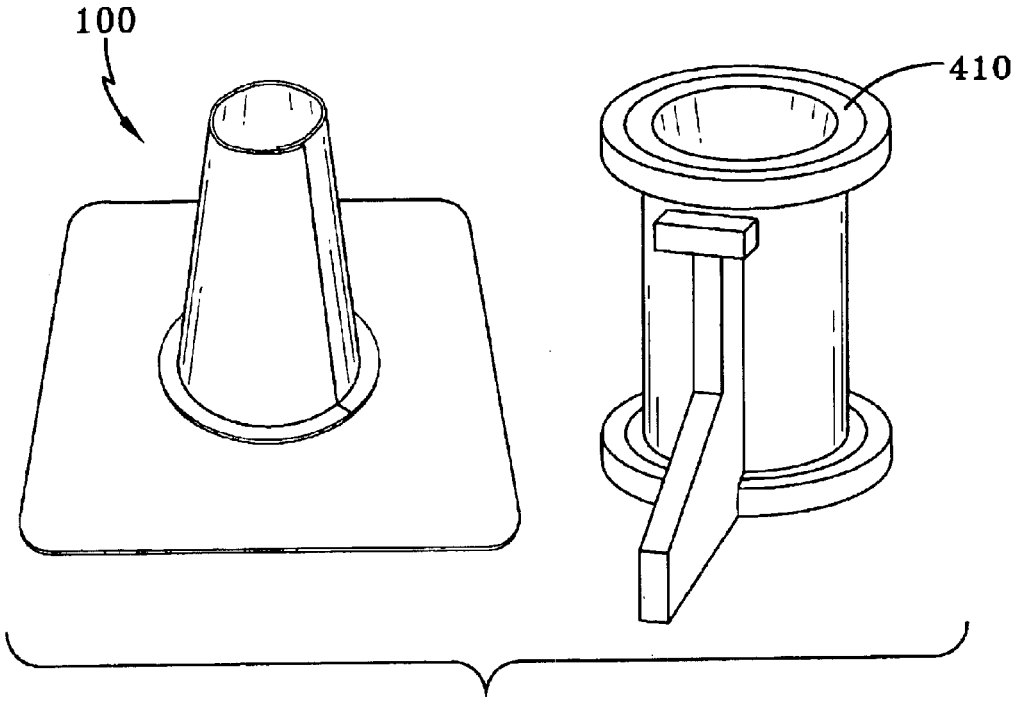
FIGS. 20, 21, 22 and 23 illustrates dies of various size that are used to manufacture embodiments of the boot of the present invention. Boot embodiments that correspond to the various dies are also depicted in the figures.
Figure 21:
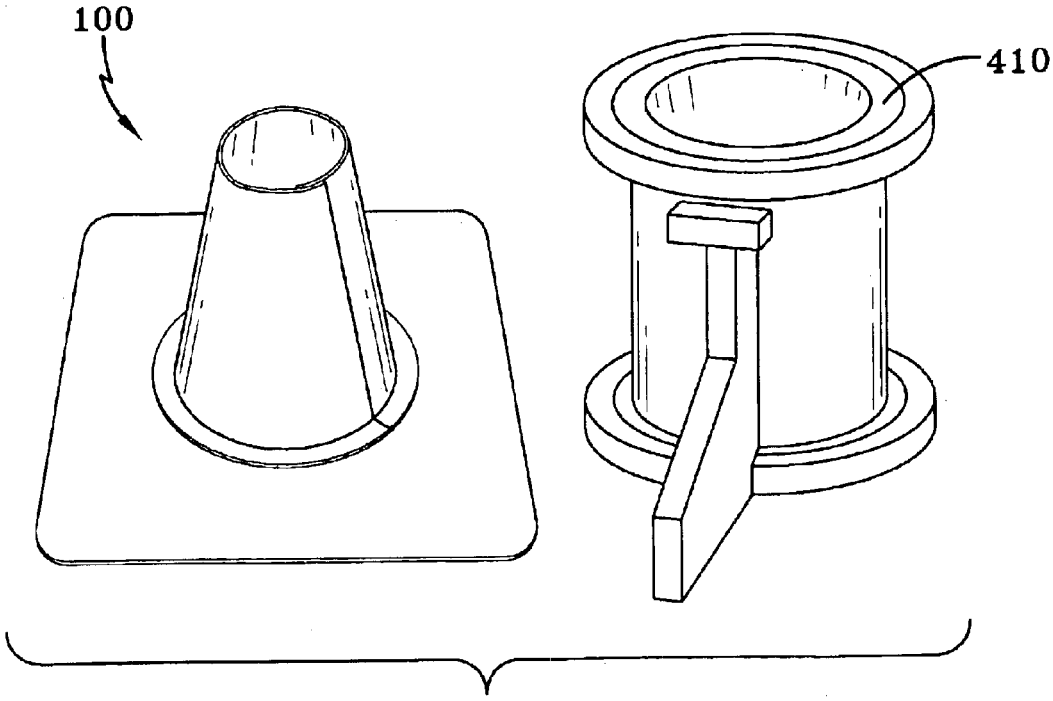
Figure 22:
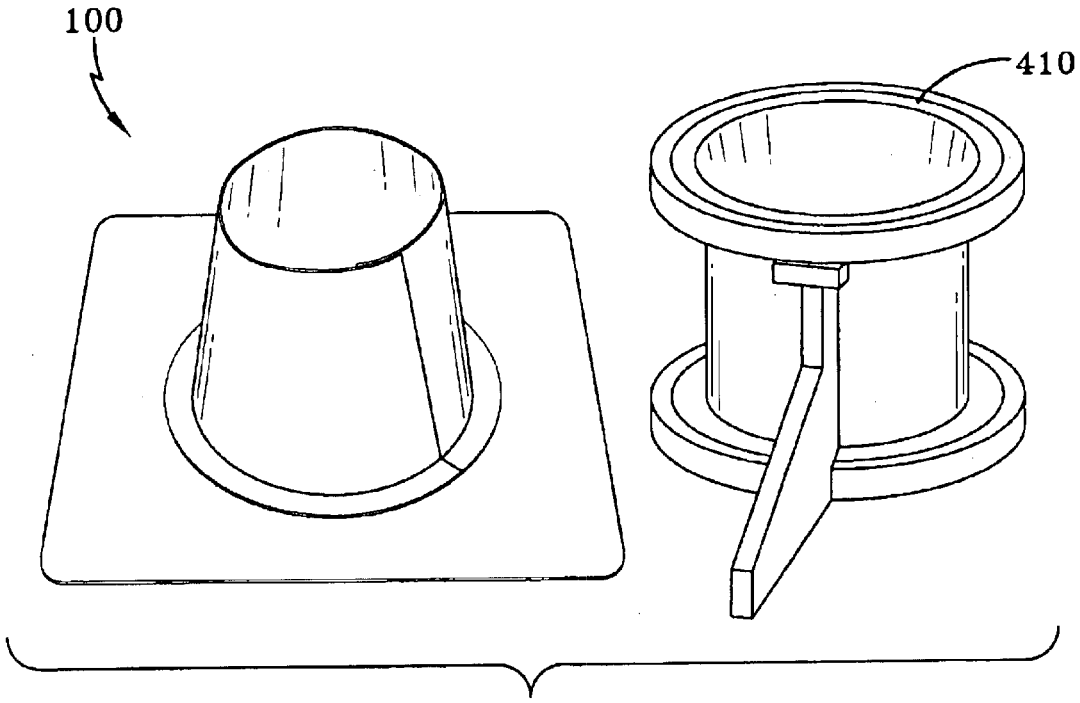
Figure 23:
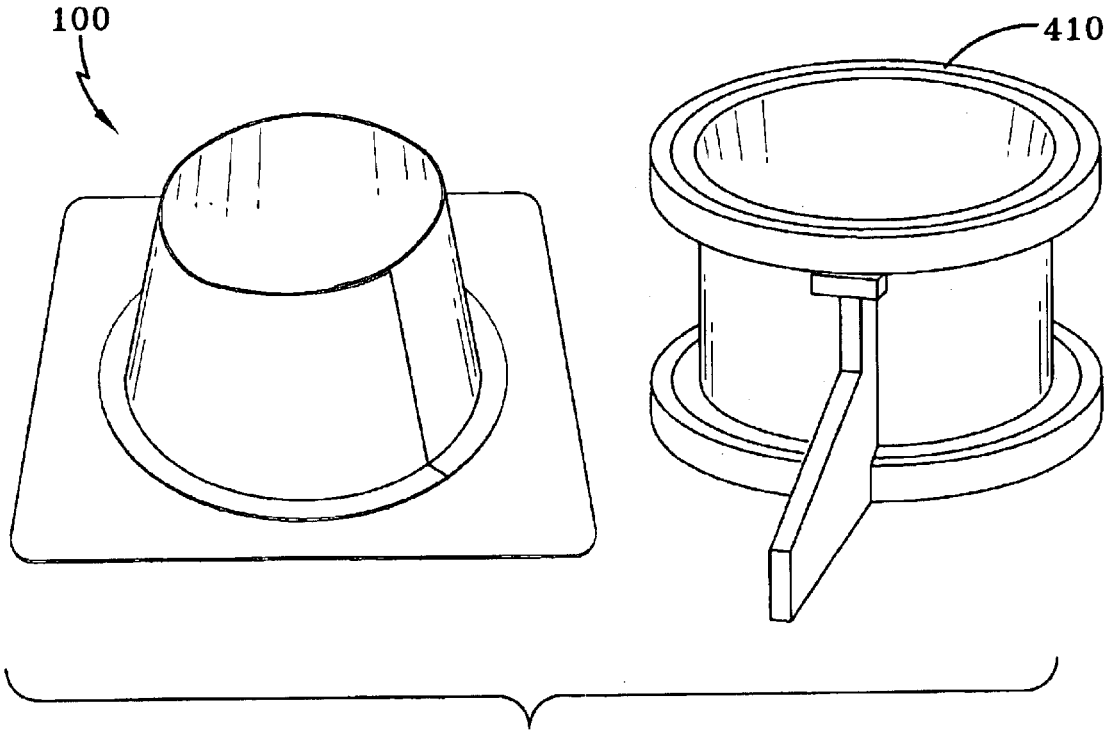

Once the protruding material 420 is heated for a sufficient amount of time, the handle 460 may be pushed downward and turned to a locking position, thereby driving the pre-shaped moveable members (e.g., pie shaped sections) 450 of the seal forming cone 440 outward, as shown in FIG. 11*d*. This action folds, but does not cut the protruding material 420 of the top portion 120. The folded protruding material 420 is also held between the bottom surface of the seal forming cone 440 and the top surface of the die 410, thereby forming a bottom edge 220 on the top portion 120 that may be a horizontally flat circumference. The flat, horizontal bottom edge 220 may then be allowed to cool naturally or with the addition of cool air to the area. The seal forming cone 440 and handle 460 combination may then be removed, leaving a top portion 120 having a bottom edge 220 that remains substantially horizontally flat, as shown in FIG. 11*e*.

FIGS. 8–11*a* and 12–19*e* illustrate particular components of the apparatus of FIG. 7 that may used to make the horizontally flat bottom edge 220 of the top portion 120. Specifically, these components comprise a die 410, seal forming cone 440, moveable sections (i.e., pies) 450, handle 460, cap 480, lock plate 600, lock plate mount 620, heat gun and cone bracket assembly 500, outer cone 560, inner cone 540, and heat gun mount 520 with heat hood supports 590.

Conical top portions 120 of various size may be made by using different die sizes. FIG. 7 illustrates different die sizes that may be used for this purpose. Also, FIGS. 20–23 illustrate various sizes of dies that may be used, as well as the finished boot 100 products that correspond to each size of die.

In an exemplary embodiment of a boot of the present invention, the horizontally flat bottom edge 220 of the top portion 120 may be placed against the edge, or perimeter, of the opening 400 in the base portion 240. Next, the base portion 240 may be sealed to the bottom edge 220 of the top portion 120. In an exemplary embodiment, the base portion 240, may be a sheet of material of a predetermined size having an opening 400 corresponding to the bottom opening 200 of the top portion 120. It is preferred that the material be of a conventional composition that lends itself to heat welding. However, other forms of sealing may be used, such as but not limited to, caulking or various types of adhesives.

In embodiments shown in FIGS. 5*a* and 5*b*, the opening 400 in the base portion 240 may be aligned with the bottom opening 200 of the top portion 120. The bottom edge 220 of the top portion 120 may then be welded to the base portion 240 such that the bottom edge 220 is substantially flat and on the same plane as the base portion 240. This weld allows the base portion 240 to lay substantially flat during the welding process, obviating the need to deform the edge 405 of the base opening 400 to accomplish the weld.

In an alternative embodiment (not shown), the edge 405 of the base opening 400 may be folded upward to make a lapped engagement with the vertical portion of the top portion 120. In such case, a lap weld may be made both along the intersection of the substantially flat base portion 240 and the bottom edge 220 of the top portion 120, as well as along the intersection of the vertical top portion 120 and upwardly bent edge 405 of the base opening 400—thereby providing a strong weld.

In an exemplary embodiment, the top portion 120 may be substantially vertical with respect to the base portion 240 when the base portion 240 is in the flat horizontal position (e.g. on the roof substrate).

In yet another exemplary embodiment, the top portion 120, having a bottom edge 220 of sufficient width, may be used without a base portion 240. In this embodiment, the top portion 120 may have a bottom edge 220 of preferably one and one half inches or greater in width. However, various widths of the bottom edge 220 may be used with this embodiment. This bottom edge 220 acts as a base and may be sealed directly to the roof membrane to provide a water-tight seal around the protrusion.

Figure 6:
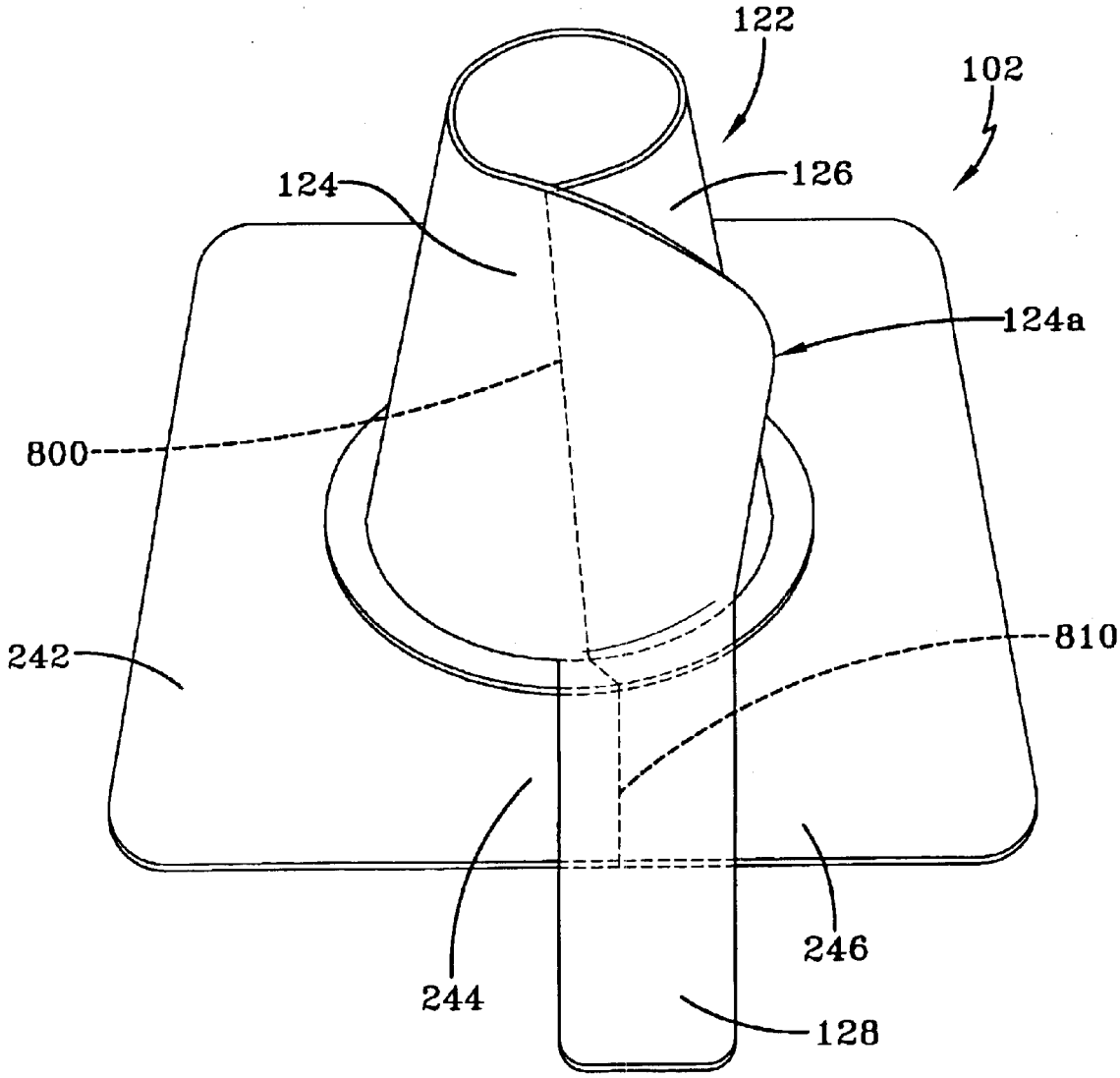
FIG. 6 illustrates a perspective view of an open stack embodiment of the boot of the present invention.

In another embodiment of the present invention, illustrated in FIG. 6, the boot (or flashing) 102 may be an open design. In other words, there may be a break 800 in the top (or vertical) portion 122 of the boot 102. The base portion 242 of the boot 102 may also have a break 810 (break 810 meets the break 800 in the top portion 122) so that the boot 102 may be opened to accept an existing vertical protrusion on the roof.

As illustrated in FIG. 6, the break 810 in the base portion 242 separates a first portion 244 of the base portion 242 from a second portion 246 of the base portion 242. The break 800 in the top portion 122 separates a first portion 124 of the top portion 122 from a second portion 126 of the top portion 122.

In an exemplary embodiment of the open stack boot 102, the break 810 in the base portion 242 is aligned with the break 800 in the top portion 122. The breaks 800, 810 in the boot 102 allows the boot 102 to be opened to accept a protrusion on the roof to be covered. After wrapping the protrusion, the top and base portions 122, 242 may be welded along the breaks 800, 810 to complete the seal.

The boot 102 of the open stack embodiment may also have a base flap 128 which may be used to seal together the first portion 244 and the second portion 246 of the base portion 242. In one embodiment, the base flap 128 is part of an overlap portion 124*a* that is used to bond or weld the first portion 124 and the second portion 126 of the top portion 122 together. In an alternative embodiment, the base flap 128 may be connected to another portion of the boot 102 (e.g., base or non-overlapping portion). It is appreciated that there may be different size stacks for the various size pipes.

The boot 100 of the present invention may be installed by placing the bottom opening 200 of the top portion 120 and the base opening 400 of the base portion 240 over the protrusion (e.g. pipe) to be covered. The top opening 180 of the top portion 120 should not be higher than the top of the protrusion. The base portion 240 may be flat over the roof. Next, the top portion of the side edge 360 (e.g. the flap portion 270) of the vertical top portion 120 may be pulled around the protrusion so that the top opening 180 is adjusted to fit the diameter of the protrusion. The top opening 180 of the top portion 120 may then be sealed around the protrusion. In an exemplary embodiment, the top portion of the side edge (e.g. the flap portion 270) may be heat sealed or welded to the corresponding top portion of the other side edge 340, on site. The base portion 240 may then be heat sealed or welded to the underlying roofing membrane to provide a water-tight seal around the protrusion.

The boot 102 of the present invention which has an open design (open stack) may be installed by opening the boot 102 along the breaks 800, 810. The first portions 244, 124 of the base portion 242 and the top portion 122 may be pulled around the protrusion and sealed to the second portions 246, 126 of the base portion 242 and top portion 122, respectively. Specifically, the first portion 124 of the top portion 122 may be sealed to the second portion 126 of the top portion 122, while the first portion 244 of the base portion 242 may be sealed to the second portion 246 of the base portion 242 after it is pulled around the protrusion. Then the boot 102 may be sealed to the roof membrane as described above.

In an alternate embodiment, a top portion 120, having a bottom edge 220 of sufficient width, may be used without a base portion 240. In this embodiment, the top portion 120 may be installed by placing the bottom opening 200 of the top portion 120 over the protrusion (e.g. pipe) to be covered. The top opening 180 of the top portion 120 should not be higher than the top of the protrusion. Next, the top portion of the side edge 360 (e.g. the flap portion 270) of the vertical top portion 120 may be pulled around the protrusion so that the top opening 180 may be adjusted to fit the diameter of the protrusion. The top opening 180 of the top portion 120 may then be sealed around the protrusion. The bottom edge 220 of the top portion 120, may act as a base and then be heat sealed or welded directly to the underlying roofing membrane to provide a water-tight seal around the protrusion. In this exemplary embodiment, the bottom edge 220 of the top portion 120 may be about one and one half inches or greater in width. However, various widths of this bottom edge 220 may accomplish a seal with the underlying roof membrane without a base portion 240.

The boots 100, 102 of the present invention allow for easier and more cost-effective manufacture and installation and also allow for the water-tight sealing of pipes of various diameters.

The boots 100, 102 of the present invention may be made of various materials including, but not limited to, thermoplastic materials such as polyvinyl chloride (PVC), and thermoplastic polyolefin (TPO). Additionally, various methods of sealing the material may be used. These methods included, but are not limited to welding, hot air bonding, caulking or the use of various types of adhesives.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. An apparatus for covering a protrusion on a roof, said apparatus comprising:

a base portion having an opening;

a top portion attached to said base portion along said opening in said base portion;

a base flap; and a break in said base portion and said top portion, said break in said base portion separating a first portion of said base portion from a second portion of said base portion, and wherein said break in said top portion separates a first portion of said top portion from a second portion of said top portion, wherein said break allow said apparatus to be opened to accept a protrusion on the roof to be covered and wherein said first portions of said base portion and said top portion are adapted to be thereafter pulled around to best fit around said protrusion and sealed to said second portions of said base portion and top portion, respectively; and wherein said base flap covers said first portion of said base portion and said second portion of said base portion when installed around said protrusion.

2. An apparatus according to claim 1, wherein said base flap extends from a bottom end of said top portion.

3. An apparatus according to claim 1, wherein said base flap is welded over said first and second portions of said base portion.

4. An apparatus accordingly to claim 1, wherein said base flap is welded under said first and second portions of said base portion.

5. An apparatus according to claim 1, wherein said base flap extends from a bottom end of said top portion interposed between said first portion of said base portion and said second portion of said base portion.

* * * * *

UNITED STATES PATENT AND TRADEMARK OFFICE

CERTIFICATE OF CORRECTION

PATENT NO. : 6,892,499 B1
DATED : May 17, 2005
INVENTOR(S) : Mayle

It is certified that error appears in the above-identified patent and that said Letters Patent is hereby corrected as shown below:

Title page,
Item [56], References Cited, please insert the following:
-- FOREIGN PATENT DOCUMENTS

| COUNTRY | PATENT NO. | INVENTOR(S) |
|---|---|---|
| Germany | DE3321101 | Heikki |
| Great Britain | 1 310 003 | Bambrough |
| Great Britain | 1 355 517 | McDonald |
| Great Britain | 1 511 729 | Hydes et al. |
| Japan | JP49-002675 | |
| Switzerland | 221530 | Allschwil |

OTHER PUBLICATIONS

1. Alkor Single Ply Roofing Systems brochure
2. At Last Roofing, Inc. catalog with technical product literature and detail drawings, 1986.
3. Benoit E.P.D.M. Roofing Systems brochure
4. Bond Cote Roofing Systems detail drawings 7-5.1, 7-6, 7-6.1 and 7-9, July 1988
5. Custom Seal detail drawings #1 through #41
6. Duro-Last detail drawings 7.10 and 7.11, June 1983
7. Duro-Last Roofing, Inc., The Complete Roofing System, product overview with sample advertisements
8. Duro-Last Roofing, Inc. Factory Mutual System Manual, technical product literature and drawings, approximately from the mid-1980's
9. Duro-Last Roofing, Inc. information manual with technical product literature and drawings , approximately from 1991-1994
10. Duro-Last Roofing, Inc. information manual with technical product literature, drawings, and pictures
11. Duro-Last Roofing, Inc. manual with product detail and literature, January 1, 1992 edition
12. GAF Roofing Products brochure, 1983
13. Gates Engineering Single Ply Elastomeric Sheet Roofing Systems brochure
14. GenFlex Roofing Systems detail drawings 1.02 - 1.06, 2.02 - 2.04, 3.01, 3.03 - 3.09, 4.03, 5.03, 6.02, 7.01 - 7.03, 8.02 - 8.03, 10.01 - 10.02, 11.01 - 11.03, 14.07 - 14.08, 16.01 - 16.03, 18.02, 19.04 - 19.06, 90.00 - 90.01, 91.04, 91.07 - 91.09, 1994

UNITED STATES PATENT AND TRADEMARK OFFICE

CERTIFICATE OF CORRECTION

PATENT NO. : 6,892,499 B1
DATED : May 17, 2005
INVENTOR(S) : Mayle

It is certified that error appears in the above-identified patent and that said Letters Patent is hereby corrected as shown below:

Title page (cont'd),

15. General Tire All Climate Roofing Systems brochure, 1982
16. General Tire Building and Products Company, The General Tire and Rubber Company, Field Fabricated Pipe Boot spec sheet F-3.01, June 1, 1983
17. GTR Building and Products Company, The General Tire and Rubber Company, GenSeal ACR Roofing System Roof Pipe Penetration spec sheet
18. GTR Building and Products Company, The General Tire and Rubber Company, Prefabricated Pipe Boot spec sheet F-3.03, June 1, 1984
19. i.p.w. Interplastic Interoof Roofing Systems brochure
20. Johns-Manville Manual for Built-Up Roof Systems brochure, 1983
21. J.P. Stevens Hi-Tuff single-ply membrane roofing system brochure
22. Koppers The Roofing People brochure
23. Mayle, Steve. Side elevational view of Custom Seal's corner piece fig. 7
24. Mule-Hide Products Co., Inc. detail drawings MH-112 and MH-121, February 1, 1993
25. Owens-Corning Fiberglass PermaPly-R brochure, 1982
26. Polyken Roofing Systems brochure
27. Rubber & Plastics Compound Company, Inc. Single Ply Membrane Roofing brochure
28. Sarnafil detail drawings 5.1 - 5.3, 1984
29. Sarnafil Roofing Membranes brochure
30. Seal-Dry/USA, inc. detail drawings 7.1, 7.2, 10.1, FA-410 - FA-413, FA-604, FA-701, EQ-305 - EQ-308, EQ-601 - EQ-602, June 1, 1994
31. Seaman Corporation, Fiberlite Single Ply Roof, field fabricated pipe flashing drawing FTR-D19, October 1986
32. Seaman Corporation, Fiberlite Single Ply Roof, pre-formed pipe flashing drawing FTR-DP3, January 1, 1996
33. Siplast brochure
34. Tamko Built-Up Roofing Systems brochure, 1983
35. Trocal Roofing Systems brochure
36. WeatherGard Single Ply Elastomeric Roofing Systems brochure --

Signed and Sealed this

Sixteenth Day of August, 2005

JON W. DUDAS
*Director of the United States Patent and Trademark Office*

US006892499C1

(12) EX PARTE REEXAMINATION CERTIFICATE (9129th)

United States Patent

Mayle

(10) Number: US 6,892,499 C1

(45) Certificate Issued: *Jul. 10, 2012

(54) APPARATUS AND METHOD FOR SEALING A VERTICAL PROTRUSION ON A ROOF

(75) Inventor: Steven R. Mayle, Fremont, OH (US)

(73) Assignee: Custom Seal, Inc., Fremont, OH (US)

Reexamination Request:
No. 90/012,032, Dec. 2, 2011

Reexamination Certificate for:

| | |
|---|---|
| Patent No.: | **6,892,499** |
| Issued: | **May 17, 2005** |
| Appl. No.: | **10/124,931** |
| Filed: | **Apr. 18, 2002** |

( * ) Notice: This patent is subject to a terminal disclaimer.

Certificate of Correction issued Aug. 16, 2005.

Related U.S. Application Data

(60) Provisional application No. 60/353,251, filed on Feb. 1, 2002.

(51) Int. Cl.

| | |
|---|---|
| ***E04H 12/28*** | (2006.01) |
| ***E04C 2/52*** | (2006.01) |
| ***E04D 1/36*** | (2006.01) |
| ***E04D 13/14*** | (2006.01) |

(52) U.S. Cl. ..... 52/219; 52/218; 52/220.8; 52/58; 285/42; 285/43

(58) Field of Classification Search ..... None
See application file for complete search history.

(56) References Cited

To view the complete listing of prior art documents cited during the proceeding for Reexamination Control Number 90/012,032, please refer to the USPTO's public Patent Application Information Retrieval (PAIR) system under the Display References tab.

*Primary Examiner*—Russell Stormer

(57) ABSTRACT

The present invention is a boot and a method of making a boot for providing a water-tight seal around a protrusion on a roof. The boot may have a top portion adapted to surround a predetermined portion of the protrusion to be covered. The bottom end of the top portion has a bottom opening and a horizontally flat bottom edge. The boot may be installed by placing the bottom opening of the top portion over a protrusion to be covered so that the base portion is substantially flat on the roof. The top opening of the top portion may then be pulled around the protrusion so that it may be adjusted to fit the protrusion. Then the top opening of the top portion may be sealed around the protrusion and the base portion may be sealed to the roofing membrane.

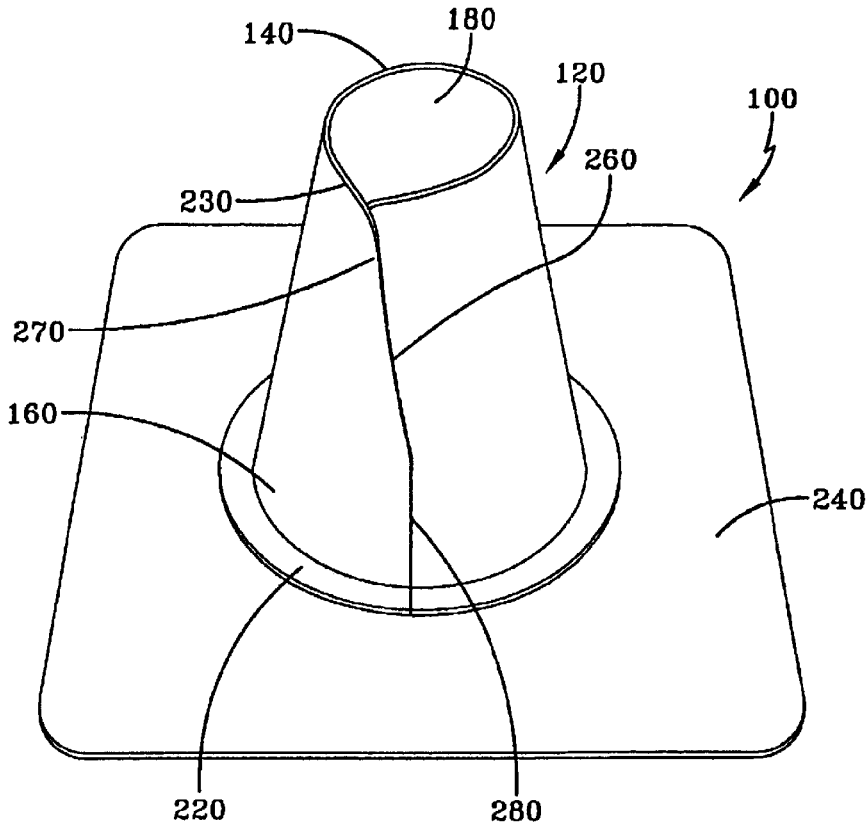

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2-5, dependent on an amended claim, are determined to be patentable.

New claim 6 is added and determined to be patentable.

1. An apparatus for covering a protrusion on a roof, said apparatus comprising:

a base portion having an opening;

a top portion attached to said base portion along said opening in said base portion;

a base flap*, said base flap and said top portion are formed of a single-piece of material*; and a break in said base portion and said top portion, said break in said base portion separating a first portion of said base portion from a second portion of said base portion, and wherein said break in said top portion separates a first portion of said top portion from a second portion of said top portion, wherein said break allows said apparatus to be opened to accept a protrusion on the roof to be covered and wherein said first portions of said base portion and said top portion are adapted to be thereafter pulled around to best fit around said protrusion and sealed to said second portions of said base portion and top portion, respectively; and wherein said base flap covers said first portion of said base portion and said second portion of said base portion when installed around said protrusion.

*6. An apparatus for covering a protrusion on a roof, said apparatus comprising:*

*a base portion having an opening;*

*a top portion attached to said base portion along said opening in said base portion;*

*a base flap, said base flap and said top portion are formed of a single-piece of material; and*

*a break in said base portion and said top portion, said break in said base portion separating a first poriton of said base portion from a second portion of said base portion, and wherein said break in said top portion separates a first portion of said top portion from a second portion of said top portion,*

*wherein said break allows said apparatus to be opened to accept a protrusion on the roof to be covered and wherein said first portions of said base portion and said top portion are adapted to be thereafter pulled around to best fit around said protrusion and sealed to said second portions of said base portion and top portion, respectively, wherein said first portion and second portion of said top portion overlap; and*

*wherein said base flap covers said first portion of said base portion and said second portion of said base portion when installed around said protrusion.*

* * * * *